US010014567B2

(12) United States Patent
Rofougaran et al.

(10) Patent No.: US 10,014,567 B2
(45) Date of Patent: Jul. 3, 2018

(54) ANTENNA ARRANGEMENTS AND ROUTING CONFIGURATIONS IN LARGE SCALE INTEGRATION OF ANTENNAS WITH FRONT END CHIPS IN A WIRELESS RECEIVER

(71) Applicant: Movandi Corporation, Newport Beach, CA (US)

(72) Inventors: Ahmadreza Rofougaran, Newport Coast, CA (US); Farid Shirinfar, Granada Hills, CA (US); Sam Gharavi, Irvine, CA (US); Michael Boers, South Turramurra (AU); Seunghwan Yoon, Irvine, CA (US); Alfred Grau Besoli, Irvine, CA (US); Maryam Rofougaran, Rancho Palos Verdes, CA (US)

(73) Assignee: Movandi Corporation, Newport Beach, CA (US)

( * ) Notice: Subject to any disclaimer, the term of this patent is extended or adjusted under 35 U.S.C. 154(b) by 159 days.

(21) Appl. No.: 15/255,656

(22) Filed: Sep. 2, 2016

(65) Prior Publication Data

US 2018/0069292 A1 Mar. 8, 2018

(51) Int. Cl.

| | |
|---|---|
| ***H01Q 1/22*** | (2006.01) |
| ***H01Q 1/38*** | (2006.01) |
| ***H01Q 3/26*** | (2006.01) |

(52) U.S. Cl.

CPC ..... *H01Q 1/2275* (2013.01); *H01Q 1/38* (2013.01); *H01Q 3/26* (2013.01)

(58) Field of Classification Search

CPC combination set(s) only.
See application file for complete search history.

(56) References Cited

U.S. PATENT DOCUMENTS

| | | | | |
|---|---|---|---|---|
| 2014/0184439 | A1* | 7/2014 | Ainspan | H01Q 3/28 342/188 |
| 2015/0129668 | A1* | 5/2015 | Kam | H01Q 1/2283 235/492 |
| 2015/0324683 | A1* | 11/2015 | Linfield | G06K 19/07769 235/492 |
| 2016/0141248 | A1* | 5/2016 | Pueschner | H01L 21/56 257/679 |

* cited by examiner

*Primary Examiner* — Junpeng Chen
(74) *Attorney, Agent, or Firm* — Farjami & Farjami LLP

(57) ABSTRACT

A wireless receiver includes a plurality of RF front end chips that receive phase shift signals or amplitude control signals, and output V-combined and H-combined signals. The wireless receiver also includes groups of antennas surrounding each of the plurality of RF front end chips. Each of the plurality of RF front end chips can be surrounded by a group of four antennas in an H-configuration, a group of six antennas in a rectangular- or a hexagonal-configuration, or a group of eight antennas in a rectangular- or an octagonal-configuration. Each of the group of four, six or eight antennas is coupled to a corresponding RF front end chip through antenna feed lines having substantially equal lengths. In another implementation, a pair of RF front end chips uses differential signals to communicate with at least two antennas of a group of antennas surrounding the pair of RF front end chips.

21 Claims, 28 Drawing Sheets

ANTENNA ARRANGEMENTS AND ROUTING CONFIGURATIONS IN LARGE SCALE INTEGRATION OF ANTENNAS WITH FRONT END CHIPS IN A WIRELESS RECEIVER

RELATED APPLICATION(S)

The present application is related to U.S. patent application Ser. No. 15/225,071, filed on Aug. 1, 2016, and titled "Wireless Receiver with Axial Ratio and Cross-Polarization Calibration," and U.S. patent application Ser. No. 15/225,523, filed on Aug. 1, 2016, and titled "Wireless Receiver with Tracking Using Location, Heading, and Motion Sensors and Adaptive Power Detection," and U.S. patent application Ser. No. 15/226,785, filed on Aug. 2, 2016, and titled "Large Scale Integration and Control of Antennas with Master Chip and Front End Chips on a Single Antenna Panel." The disclosures of these related applications are hereby incorporated fully by reference into the present application.

BACKGROUND

Wireless communications, such as satellite communications, utilize electromagnetic signals to transfer information between two or more points. An antenna panel integrated on a single printed circuit board ("PCB") employing hundreds or thousands of antennas is a novel approach to receive desired electromagnetic signals by appropriate beamforming while presenting a low profile and a small form factor, resulting in a conveniently portable antenna panel without requiring any mechanical parts or mechanical adjustments. However, such an antenna panel presents challenges in arranging and organizing hundreds or thousands of antennas on a single PCB, with significant challenges for routing electrical signals. For example, each of the hundreds or thousands of antennas may need to deliver amplitude and phase information of a received electromagnetic signal to a corresponding one of hundreds of RF front end chips that is in turn connected to a master chip for signal processing. The organization and arrangement of antenna feed lines and differences in length of antenna feed lines between the antennas and their corresponding RF front end chips can result in transmission loss and undesired variations in the received signals and cross-talk between the feed lines, all of which can in turn reduce signal strength and quality received by RF front end chips and cause an increase in bit error rate (BER) in the wireless receiver.

Thus, there is need in the art to overcome the drawbacks in using antenna panels with hundreds or thousands of antennas integrated on a single PCB along with tens or hundreds of RF front end chips integrated on the same PCB, and provide a wireless receiver having novel antenna arrangements, and efficient routing configurations for large scale integration of the antennas with the RF front end chips on the single PCB.

SUMMARY

The present disclosure is directed to novel antenna arrangements and routing configurations in large scale integration of antennas with front end chips in a wireless receiver, substantially as shown in and/or described in connection with at least one of the figures, and as set forth in the claims.

DETAILED DESCRIPTION

Figure 1:
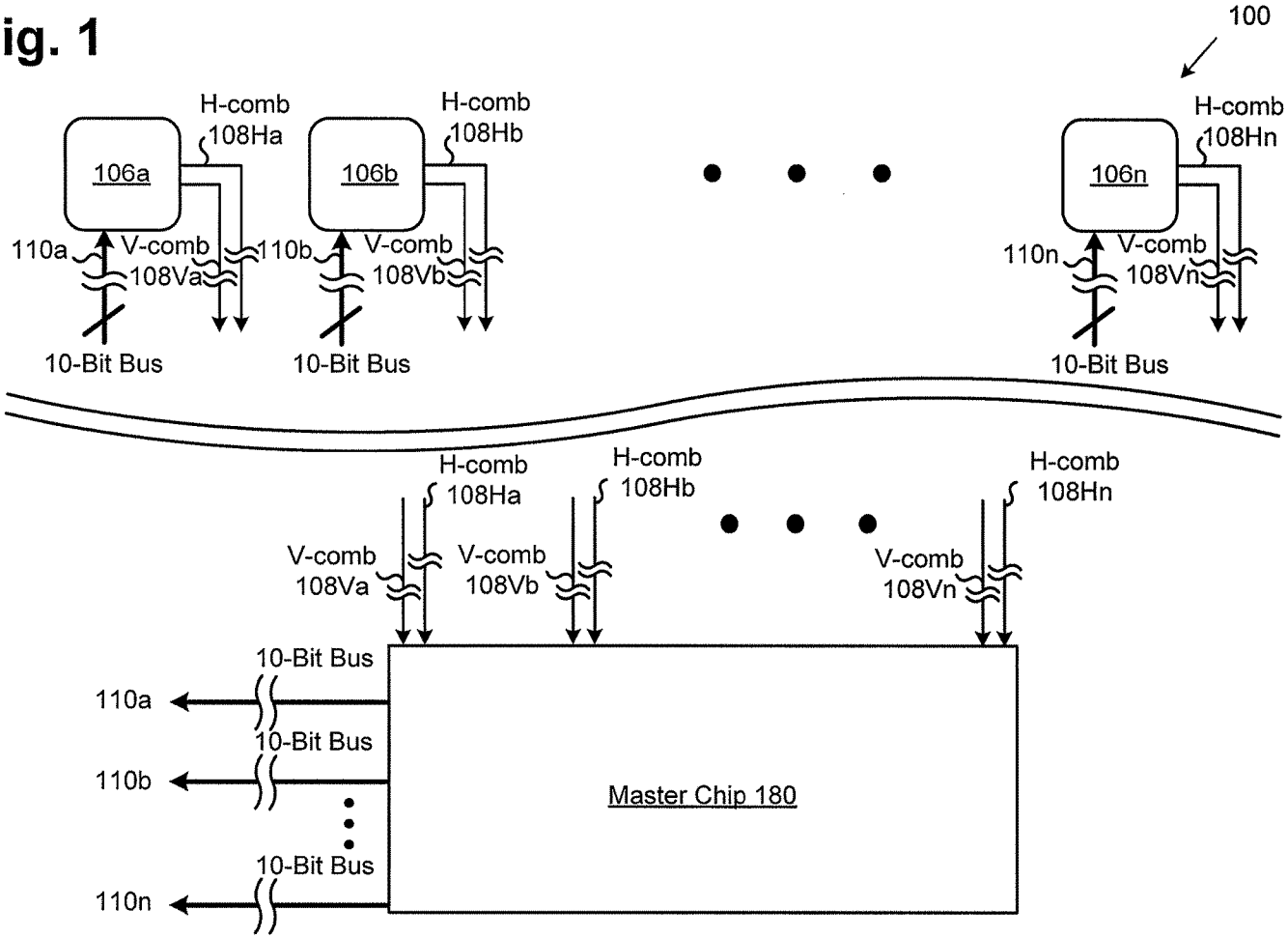
FIG. 1 illustrates a functional block diagram of a portion of an exemplary wireless receiver according to one implementation of the present application.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

Referring now to FIG. 1, FIG. 1 illustrates a functional block diagram of a portion of an exemplary wireless receiver according to one implementation of the present application. As illustrated in FIG. 1, wireless receiver 100 includes radio frequency (RF) front end chips 106*a*, 106*b* through 106*n*, (collectively referred to as RF front end chips 106*a* through 106*n*) and master chip 180. Each of RF front end chips 106*a* through 106*n* may be connected to a plurality of antennas (not explicitly shown in FIG. 1). For example, in one implementation, wireless receiver 100 may include 2000 antennas and 500 RF front end chips on an antenna panel, where each of the RF front end chips is coupled to a group of four antennas. In another implementation, wireless receiver 100 may include 3000 antennas and 500 RF front end chips on an antenna panel, where each of the RF front end chips is coupled to a group of six antennas. In yet another implementation, wireless receiver 100 may include 2000 antennas and 250 RF front end chips on an antenna panel, where each of the RF front end chips is coupled to a group of eight antennas. It should be noted that implementations of the present application are not limited by the numbers of the antennas and the RF front end chips mentioned above.

In the present implementation, each antenna of wireless receiver 100 may provide a horizontally-polarized signal and a vertically-polarized signal, as a pair of linearly polarized signals, to a corresponding RF front end chip, such as any of RF front end chips 106*a* through 106*n*. For example, each RF front end chip may combine all of the horizontally-polarized signals, by adding powers and combining phases of the individual horizontally-polarized signals, from the group of corresponding antennas coupled thereto, and provide an H-combined output to master chip 180. The RF front end chip may also combine all of the vertically-polarized signals, by adding powers and combining phases of the individual vertically-polarized signals, from the group of corresponding antennas coupled thereto, and provide a V-combined output to master chip 180.

As illustrated in FIG. 1, RF front end chip 106*a* provides H-combined output 108Ha and V-combined output 108Va to master chip 180. RF front end chip 106*b* provides H-combined output 108Hb and V-combined output 108Vb to master chip 180. RF front end chip 106*n* provides H-combined output 108Hn and V-combined output 108Vn to master chip 180. In the present implementation, master chip 180 is configured to receive the H-combined and V-combined outputs from each of the RF front end chips, and provide phase shift signals to phase shifters, and amplitude control signals to various amplifiers, in the RF front end chips through control buses, such as control buses 110*a*, 110*b* through 110*n*. In one implementation, master chip 180 is configured to drive in parallel control buses 110*a*, 110*b*, through 110*n*.

As illustrated in FIG. 1, master chip 180 receives H-combined output 108Ha and V-combined output 108Va from RF front end chip 106*a*, and provides control buses 110*a* having phase shift signals and/or amplitude control signals to RF front end chip 106*a*. Master chip 180 receives H-combined output 108Hb and V-combined output 108Vb from RF front end chip 106*b*, and provides control bus 110*b* having phase shift signals and/or amplitude control signals to RF front end chip 106*b*. Master chip 180 also receives H-combined output 108Hn and V-combined output 108Vn from RF front end chip 106*n*, and provides control bus 110*n* having phase shift signals and/or amplitude control signals to RF front end chip 106*n*. By way of one example, and without limitation, control buses 110*a*, 110*b* through 110*n* are ten-bit control buses in the present implementation. In one implementation, RF front end chips 106*a* through 106*n*, the antennas coupled to each of RF front end chips 106*a* through 106*n*, and master chip 180 are integrated on a single substrate, such as a printed circuit board.

Figure 2A:
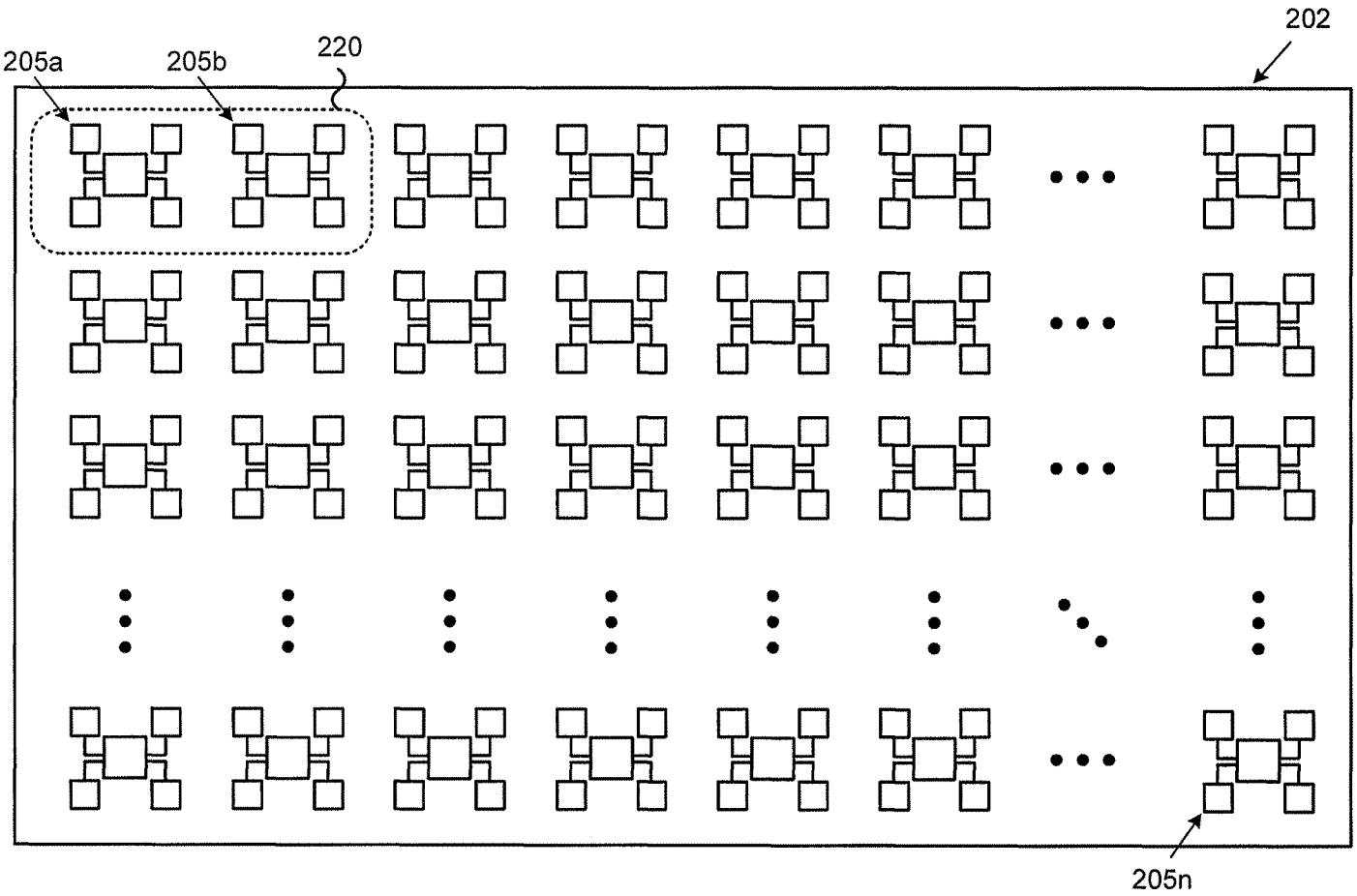
FIG. 2A illustrates a top plan view of a portion of an antenna panel of an exemplary wireless receiver according to one implementation of the present application.
Figure 2B:
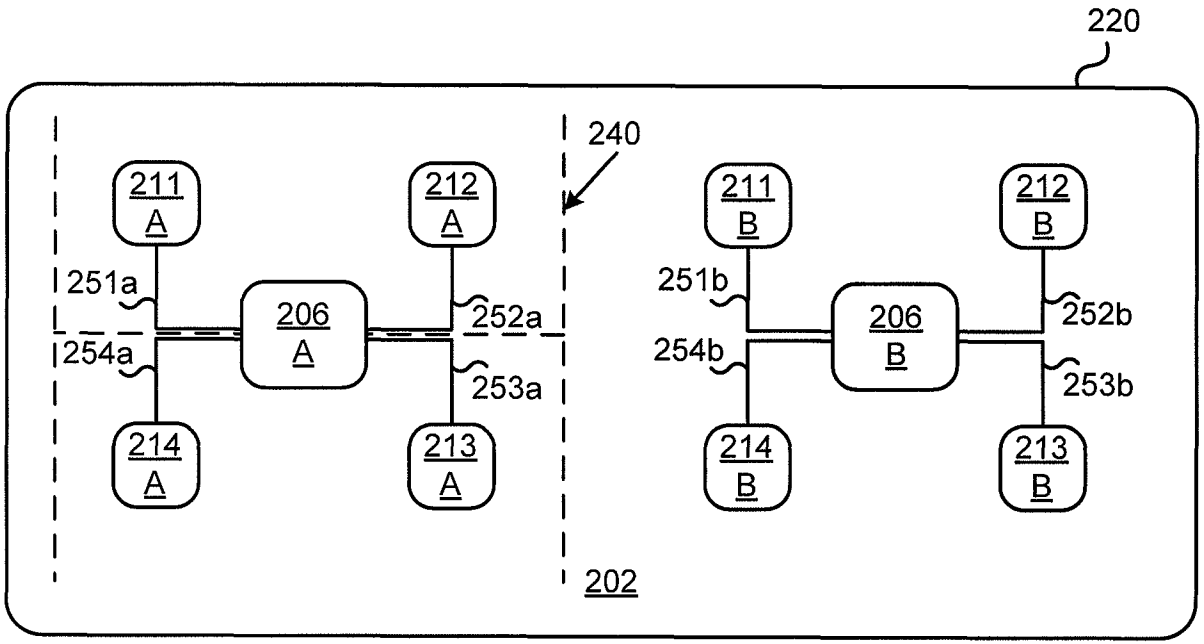
FIG. 2B illustrates a top plan view of a portion of an antenna panel of an exemplary wireless receiver according to one implementation of the present application.

Referring now to FIGS. 2A and 2B, FIG. 2A illustrates a top plan view of a portion of an antenna panel of an exemplary wireless receiver according to one implementation of the present application. FIG. 2B illustrates a section of the antenna panel in FIG. 2A. As illustrated in FIG. 2A, antenna panel 202 includes a plurality of RF front end units 205*a*, 205*b* through 205*n*. Each of RF front end units 205*a*, 205*b* through 205*n* includes an RF front end chip surrounded by a group of four antennas arranged in an H-configuration.

FIG. 2B shows an enlarged view of section 220 of antenna panel 202 in FIG. 2A. As illustrated in FIG. 2B, RF front end chip 206A is surrounded by a group of four antennas, namely, antennas 211A, 212A, 213A and 214A. RF front end chip 206A and antennas 211A, 212A, 213A and 214A may correspond to RF front end unit 205*a* in FIG. 2A. Antennas 211A, 212A, 213A and 214A are coupled to RF front end chip 206A through antenna feed lines 251*a*, 252*a*, 253*a* and 254*a*, respectively. In the present implementation, antenna feed lines 251*a*, 252*a*, 253*a* and 254*a* have substantially equal lengths. In one implementation each feed line 251*a*, 252*a*, 253*a*, and 254*a* includes a pair of lines such that one line in the pair would carry a horizontally-polarized signal while the other line in the pair would carry a vertically-polarized signal. However, for ease of illustration, each pair is shown as a single feed line, such as feed line 251*a*, even for implementations that a pair of lines are represented by each feed line.

Similarly, RF front end chip 206B is surrounded by a group of four antennas, namely, antennas 211B, 212B, 213B and 214B. RF front end chip 206B and antennas 211B, 212B, 213B and 214B may correspond to RF front end unit 205*b* in FIG. 2A. Antennas 211B, 212B, 213B and 214B are coupled to RF front end chip 206B through antenna feed lines 251*b*, 252*b*, 253*b* and 254*b*, respectively. In the present implementation, antenna feed lines 251*a*, 252*a*, 253*a*, 254*a*, 251*b*, 252*b*, 253*b* and 254*b* may have substantially equal lengths. In one implementation each feed line 251*b*, 252*b*, 253*b* and 254*b* includes a pair of lines such that one line in the pair would carry a horizontally-polarized signal while the other line in the pair would carry a vertically-polarized signal. However, for ease of illustration, each pair is shown as a single feed line, such as feed line 251*b*, even for implementations that a pair of lines are represented by each feed line.

In one implementation, antennas 211A, 212A, 213A, 214A, 211B, 212B, 213B and 214B, and the other antennas (collectively referred to as antennas 211 through 214) on antenna panel 202 as shown in FIG. 2A, may be configured to receive signals from one or more wireless transmitters, such as commercial geostationary communication satellites or low earth orbit satellites having a very large bandwidth in the 10 GHz to 20 GHz frequency range and a very high data rate. In another implementation, antennas 211 through 214 on antenna panel 202 may be configured to receive signals in the 60 GHz frequency range, sometimes referred to as "60 GHz communications," which involve transmission and reception of millimeter wave signals. Among the applications for 60 GHz communications are wireless personal area networks, wireless high-definition television signal and Point-to-Point links.

In one implementation, for a wireless transmitter transmitting signals at 10 GHz (i.e., $\lambda$=30 mm), each antenna in antenna panel 202 in a wireless receiver needs an area of at least a quarter wavelength (e.g., $\lambda/4$=7.5 mm) by a quarter wavelength (e.g., $\lambda/4$=7.5 mm) to receive the transmitted signals. As illustrated in FIGS. 2A and 2B, antennas 211 through 214 in antenna panel 202 may each have a substantially square shape having dimensions of 7.5 mm by 7.5 mm, for example. In one implementation, each adjacent pair of antennas may be separated by a distance of a multiple integer of the quarter wavelength (i.e., $n*\lambda/4$), such as 7.5 mm, 15 mm, 22.5 mm, and etc. In that implementation, each of antenna feed lines 251*a*, 252*a*, 253*a*, 254*a*, 251*b*, 252*b*, 253*b* and 254*b* may each have a length of a multiple integer of the half wavelength (i.e., $n*\lambda/2$), such as 15 mm, 30 mm, 45 mm, and etc.

In the present implementation, antenna panel 202 is a flat panel array employing antennas 211 through 214, where antenna panel 202 is coupled to associated active circuits to form a beam for reception and/or transmission. In one implementation, the beam is formed fully electronically by means of phase and amplitude control circuits associated with antennas 211 through 214. Thus, antenna panel 202 can provide for beamforming without the use of any mechanical parts.

As shown in FIG. 2B, antennas 211A, 212A, 213A and 214A are arranged in H-configuration 240, where antennas 211A, 212A, 213A and 214A are situated at the upper left hand corner, the upper right hand corner, the lower right hand corner and the lower left hand corner of the H-configuration, respectively. Similarly, antennas 211B, 212B, 213B and 214B are arranged in an H-configuration, where antennas 211B, 212B, 213B and 214B are situated at the upper left hand corner, the upper right hand corner, the lower right hand corner and the lower left hand corner of the H-configuration, respectively. In the present implementation, the antenna feed lines carry RF analog signals from the antennas to their corresponding RF front end chips. The H-configuration makes it easy for the wireless receiver to rout the signals in a symmetrical way, thereby reducing the overall length of the antenna feed lines and the cross-talk among them. In addition, the H-configuration with symmetric routing can minimize transmission loss and path delays, and increase routing efficiency, especially for antenna panels with hundreds or thousands of antennas.

It is noted that in the present implementation, the antennas, such as antennas 211A, 212A, 213A, 214A, 211B, 212B, 213B and 214B, and the RF front end chips 206A and 206B are formed on the same layer on antenna panel 202. In another implementation, the antennas of the wireless receiver may be formed on antenna panel 202, while the RF front end chips may be formed on another layer below antenna panel 202.

Figure 2C:
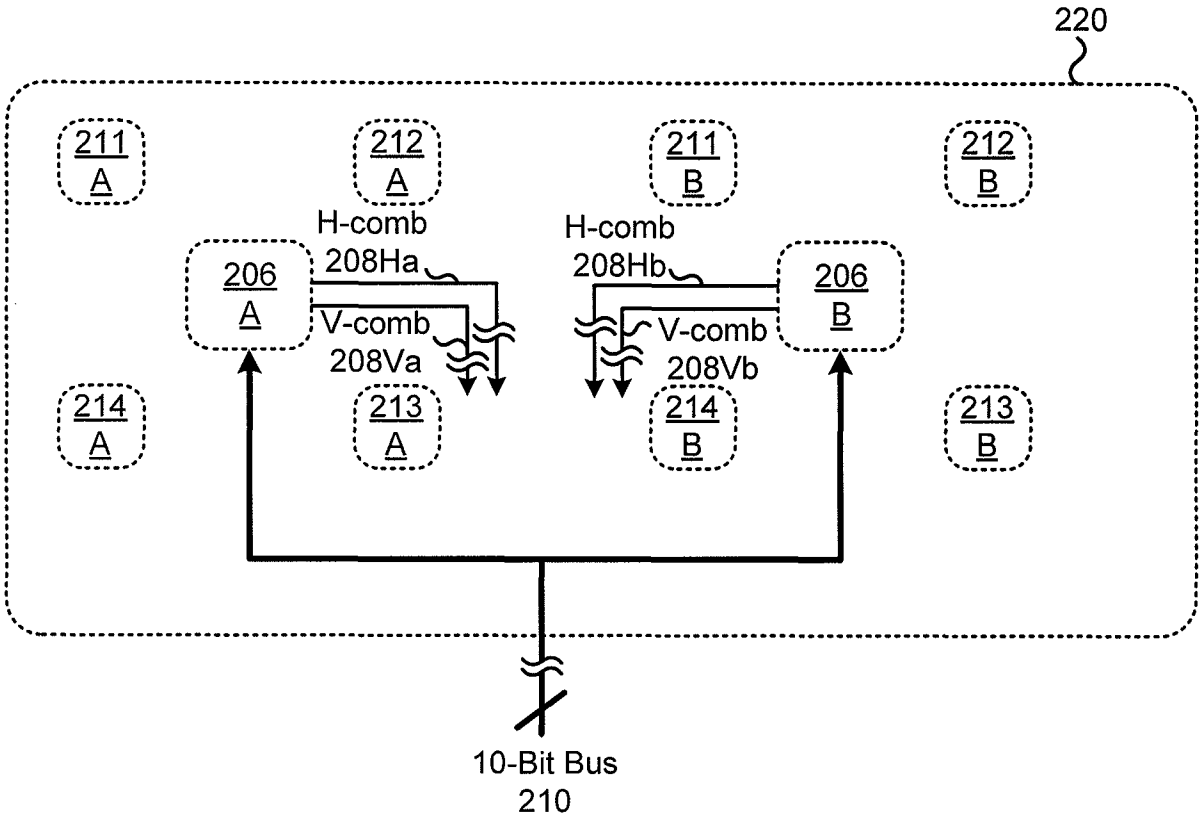
FIG. 2C illustrates a functional block diagram of a portion of an exemplary wireless receiver according to one implementation of the present application.

Referring now to FIG. 2C, FIG. 2C illustrates a functional block diagram of a portion of an exemplary wireless receiver according to one implementation of the present application. In the present implementation, section 220 in FIG. 2C may correspond to section 220 in FIGS. 2A and 2B. As shown in FIG. 2C, RF front end chip 206A combines all of the horizontally-polarized signals, by adding powers and combining phases of the individual horizontally-polarized signals, from antennas 211A, 212A, 213A and 214A, and provides H-combined output 208Ha to a master chip (not explicitly shown in FIG. 2C). RF front end chip 206A also combines all of the vertically-polarized signals, by adding powers and combining phases of the individual vertically-polarized signals, from antennas 211A, 212A, 213A and 214A, and provides V-combined output 208Va to the master chip. RF front end chip 206B combines all of the horizontally-polarized signals, by adding powers and combining phases of the individual horizontally-polarized signals, from antennas 211B, 212B, 213B and 214B, and provides H-combined output 208Hb to the master chip. RF front end chip 206B also combines all of the vertically-polarized signals, by adding powers and combining phases of the individual vertically-polarized signals, from antennas 211B, 212B, 213B and 214B, and provides V-combined output 208Vb to the master chip.

As illustrated in FIG. 2C, control bus 210 is provided, for example, from the master chip to RF front end chips 206A and 206B. In the present implementation, control bus 210 is a ten-bit control bus, for example. Control bus 210 may be configured to provide phase shift signals to one or more phase shifters (not explicitly shown in FIG. 2C) in RF front end chips 206A and 206B, where at least one of the phase shift signals is configured to cause a phase shift in at least one linearly polarized signal received from a corresponding antenna. In addition, control bus 210 may be configured to provide amplitude control signals to one or more amplifiers (not explicitly shown in FIG. 2C) in RF front end chips 206A and 206B, where at least one of the amplitude control signals is configured to cause a change in amplitude in at least one linearly polarized signal received from a corresponding antenna.

Figure 2D:
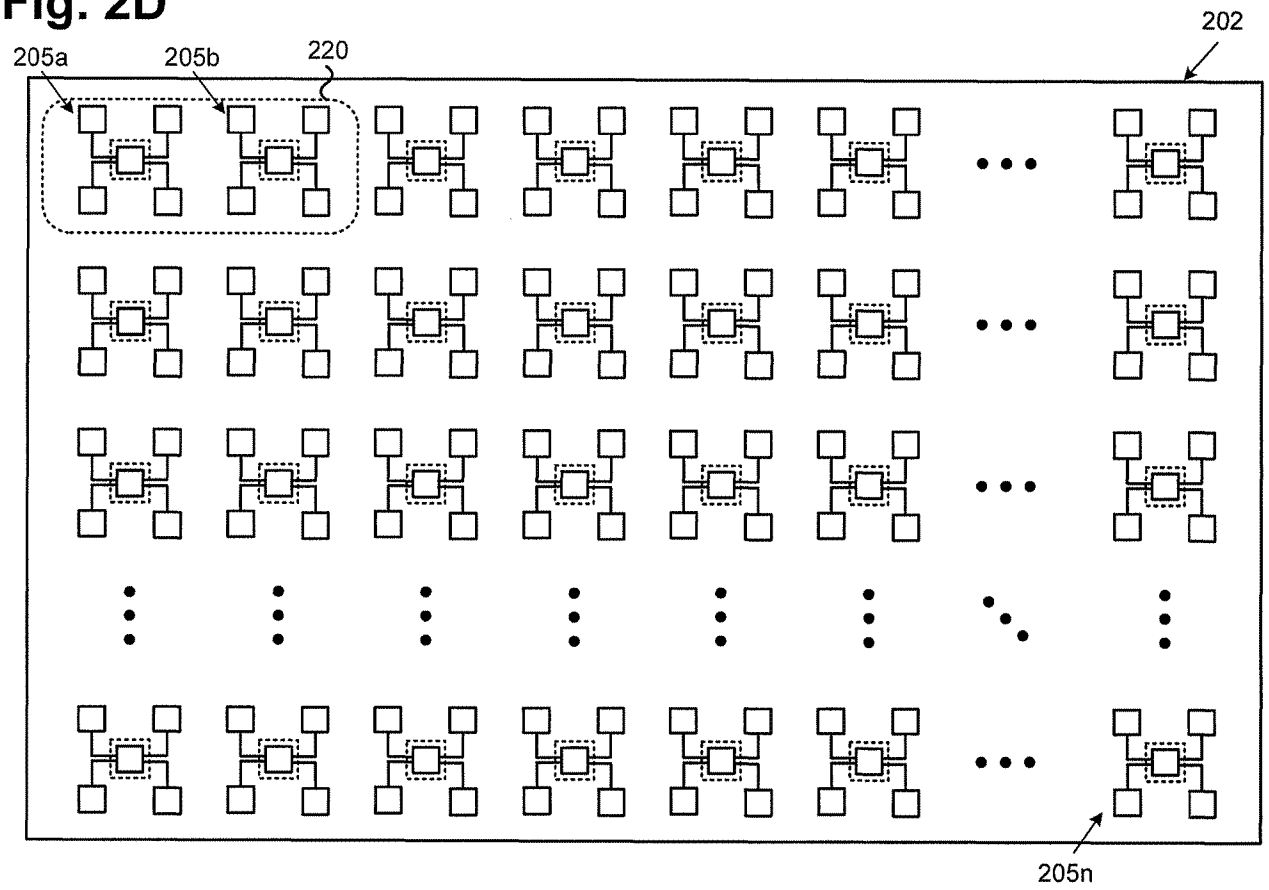
FIG. 2D illustrates a top plan view of a portion of an antenna panel of an exemplary wireless receiver according to one implementation of the present application.
Figure 2E:
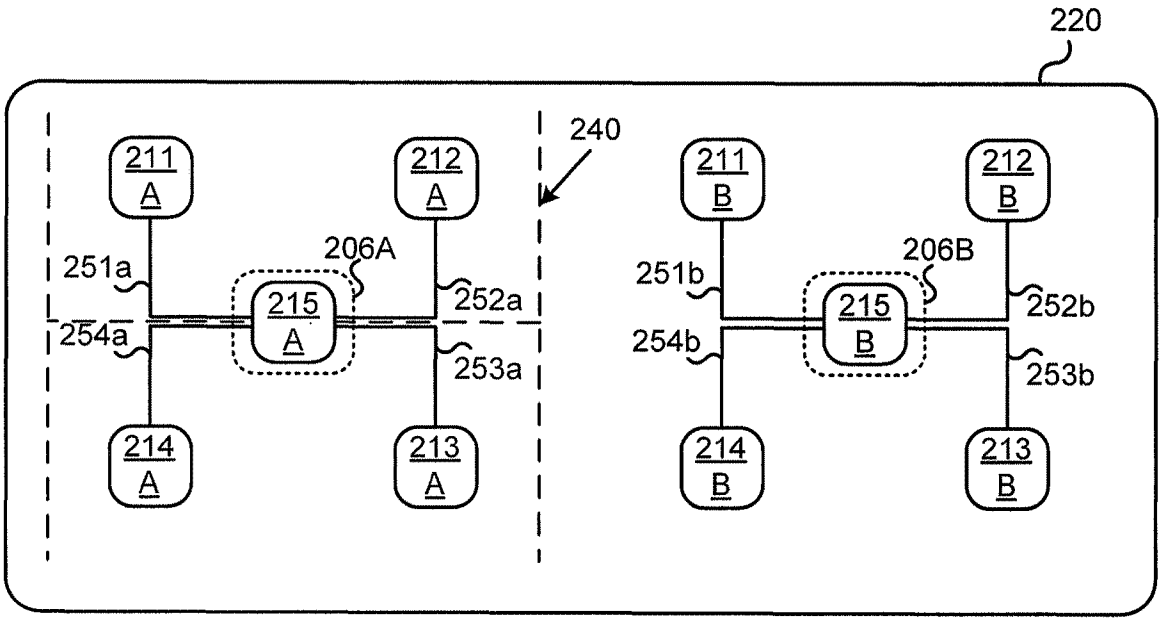
FIG. 2E illustrates a top plan view of a portion of an antenna panel of an exemplary wireless receiver according to one implementation of the present application.
Figure 2F:
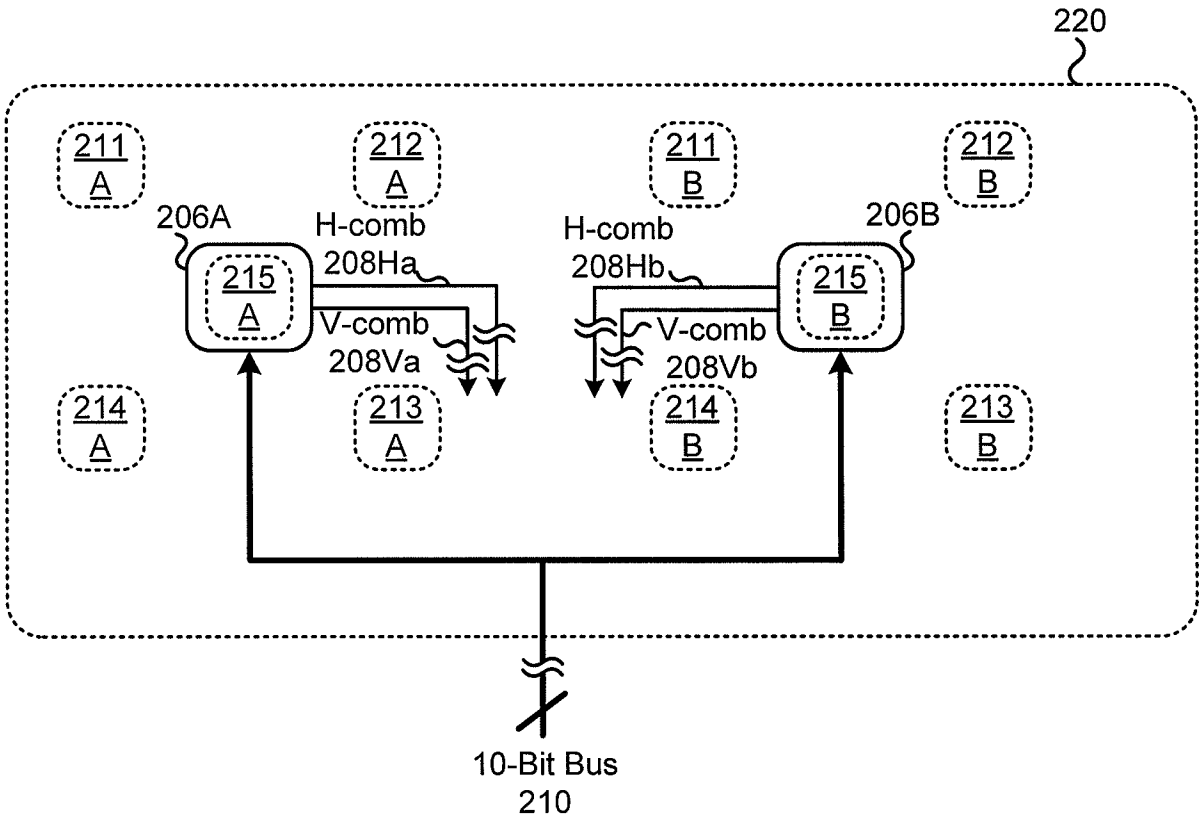
FIG. 2F illustrates a functional block diagram of a portion of an exemplary wireless receiver according to one implementation of the present application.

Referring to FIGS. 2D, 2E and 2F, with similar numerals representing similar features in FIGS. 2A, 2B and 2C, FIGS. 2D, 2E and 2F show an implementation, where each of RF front end units 205*a* through 205*n* includes an additional antenna in the center of the H-configuration. Thus, each of RF front end units 205*a* through 205*n* includes a group of five antennas. It is noted that in the implementation shown in FIGS. 2D, 2E and 2F, the RF front end chips are each situated below the additional antenna in the center of the H-configuration. For example, antenna panel 202 may be a part of a multi-layer PCB having at least two layers, where antennas 211A, 212A, 213A, 214A, 215A, 211B, 212B, 213B, 214B and 215B are situated on antenna panel 202, as a top layer of the multi-layer PCB, while RF front end chips 206A and 206B are situated in another layer of the multi-layer PCB below the top layer. As shown in FIGS. 2D, 2E and 2F, RF front end chips 206A and 206B are situated directly below antennas 215A and 215B, respectively.

Figure 3A:
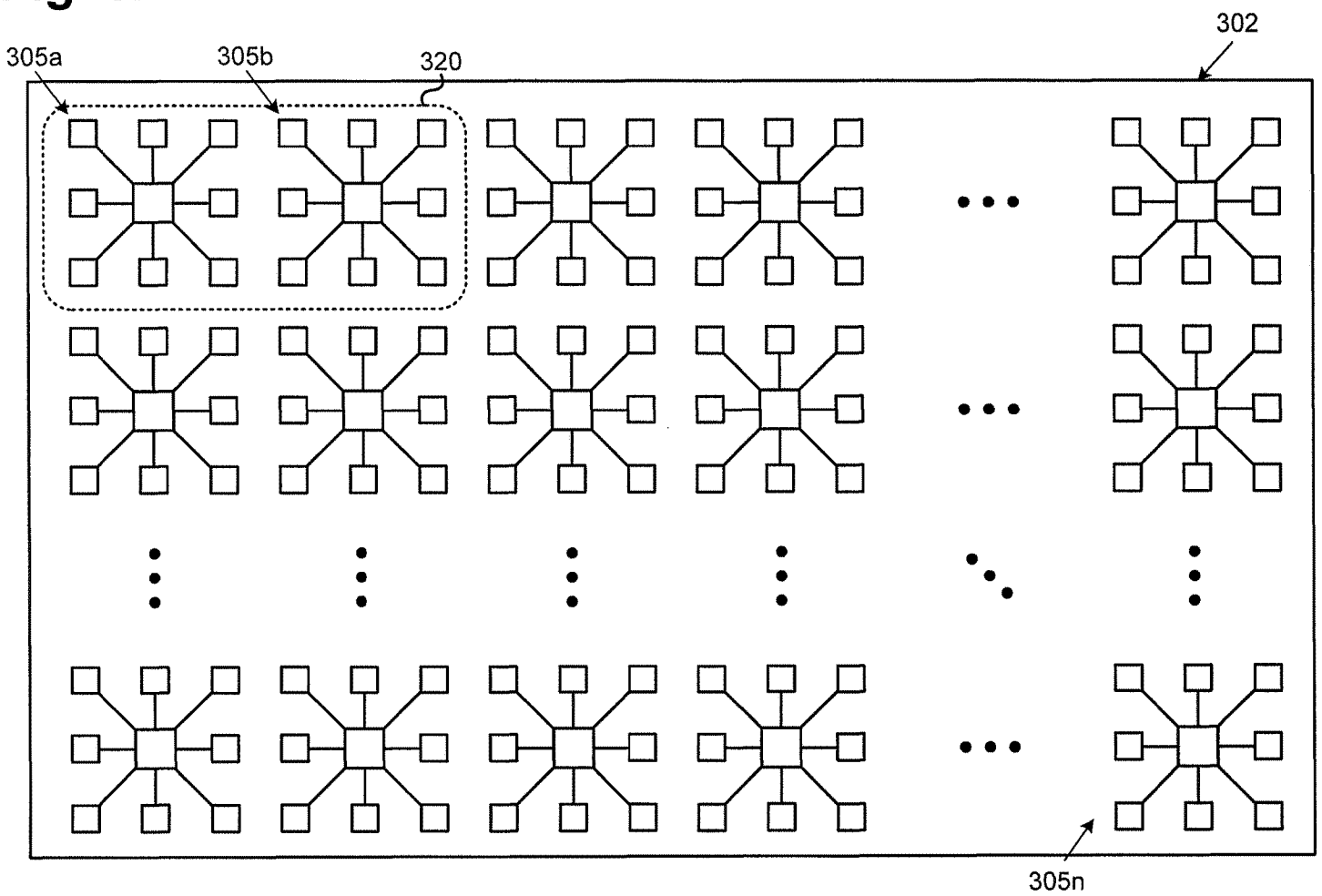
FIG. 3A illustrates a top plan view of a portion of an antenna panel of an exemplary wireless receiver according to one implementation of the present application.
Figure 3B:
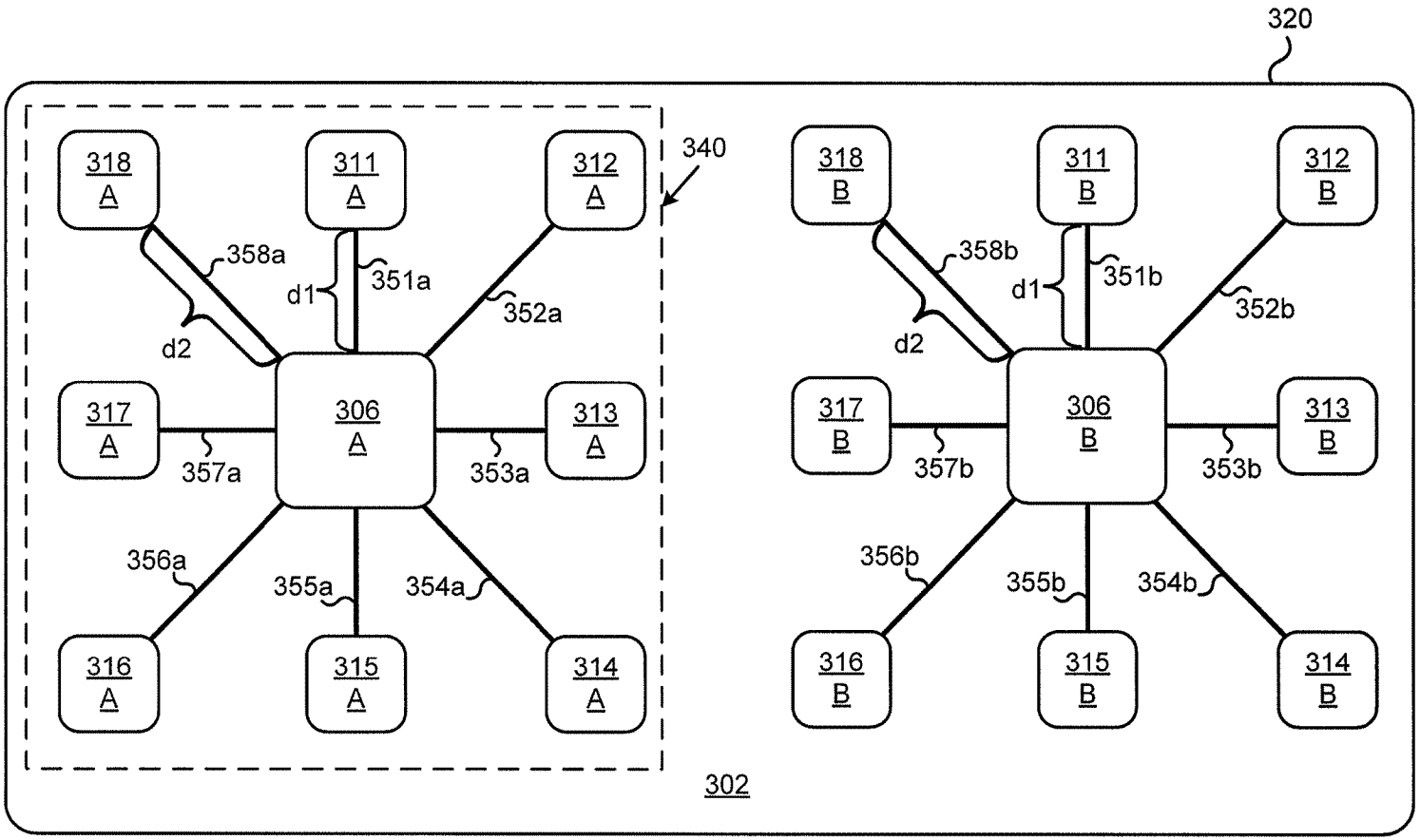
FIG. 3B illustrates a top plan view of a portion of an antenna panel of an exemplary wireless receiver according to one implementation of the present application.

Referring now to FIGS. 3A and 3B, FIG. 3A illustrates a top plan view of a portion of an antenna panel of an exemplary wireless receiver according to one implementation of the present application. FIG. 3B illustrates a section of the antenna panel in FIG. 3A. As illustrated in FIG. 3A, antenna panel 302 includes a plurality of RF front end units 305*a*, 305*b* through 305*n*. Each of RF front end units 305*a*, 305*b* through 305*n* includes an RF front end chip surrounded by a group of eight antennas arranged in a rectangular-configuration.

FIG. 3B shows an enlarged view of section 320 of antenna panel 302 in FIG. 3A. As illustrated in FIG. 3B, RF front end chip 306A is surrounded by a group of eight antennas, namely, antennas 311A, 312A, 313A, 314A, 315A, 316A, 317A and 318A. RF front end chip 306A and antennas 311A, 312A, 313A, 314A, 315A, 316A, 317A and 318A may correspond to RF front end unit 305*a* in FIG. 3A. Antennas 311A, 312A, 313A, 314A, 315A, 316A, 317A and 318A are coupled to RF front end chip 306A through antenna feed lines 351*a*, 352*a*, 353*a*, 354*a*, 355*a*, 356*a*, 357*a* and 358*a*, respectively. In the present implementation, antenna feed lines 351*a*, 353*a*, 355*a* and 357*a* may each have length d1, while antenna feed lines 352*a*, 354*a*, 356*a* and 358*a* may each have length d2, where $d2=\sqrt{2}\times d1$, for example. In one implementation each feed line 351*a*, 352*a*, 353*a*, 354*a*, 355*a*, 356*a*, 357*a* and 358*a*, includes a pair of lines such that one line in the pair would carry a horizontally-polarized signal while the other line in the pair would carry a vertically-polarized signal. However, for ease of illustration, each pair is shown as a single feed line, such as feed line 351*a*, even for implementations that a pair of lines are represented by each feed line.

Similarly, RF front end chip 306B is surrounded by a group of eight antennas, namely, antennas 311B, 312B, 313B, 314B, 315B, 316B, 317B and 318B. RF front end chip 306B and antennas 311B, 312B, 313B, 314B, 315B, 316B, 317B and 318B may correspond to RF front end unit 305*b* in FIG. 3A. Antennas 311B, 312B, 313B, 314B, 315B, 316B, 317B and 318B are coupled to RF front end chip 306B through antenna feed lines 351*b*, 352*b*, 353*b*, 354*b*, 355*b*, 356*b*, 357*b* and 358*b*, respectively. In the present implementation, antenna feed lines 351*b*, 353*b*, 355*b* and 357*b* may each have length d1, while antenna feed lines 352*b*, 354*b*, 356*b* and 358*b* may each have length d2. In one implementation, $d2=\sqrt{2}\times d1$, for example. In one implementation each feed line 351*b*, 352*b*, 353*b*, 354*b*, 355*b*, 356*b*, 357*b* and 358*b*, includes a pair of lines such that one line in the pair would carry a horizontally-polarized signal while the other line in the pair would carry a vertically-polarized signal. However, for ease of illustration, each pair is shown as a single feed line, such as feed line 351*b*, even for implementations that a pair of lines are represented by each feed line.

In one implementation, antennas 311A, 312A, 313A, 314A, 315A, 316A, 317A, 318A, 311B, 312B, 313B, 314B, 315B, 316B, 317B and 318B, and the other antennas (collectively referred to as antennas 311 through 318) on antenna panel 302 as shown in FIG. 3A, may be configured to receive signals from one or more wireless transmitters, such as commercial geostationary communication satellites or low earth orbit satellites having a very large bandwidth in the 10 GHz to 20 GHz frequency range and a very high data rate. In another implementation, antennas 311 through 318 on antenna panel 302 may be configured to receive signals in the 60 GHz frequency range, sometimes referred to as "60 GHz communications," which involve transmission and reception of millimeter wave signals. Among the applications for 60 GHz communications are wireless personal area networks, wireless high-definition television signal and Point-to-Point links.

In one implementation, for a wireless transmitter transmitting signals at 10 GHz (i.e., $\lambda=30$ mm), each antenna in antenna panel 302 in a wireless receiver needs an area of at least a quarter wavelength (e.g., $\lambda/4=7.5$ mm) by a quarter wavelength (e.g., $\lambda/4=7.5$ mm) to receive the transmitted signals. As illustrated in FIGS. 3A and 3B, antennas 311 through 318 in antenna panel 302 may each have a substantially square shape having dimensions of 7.5 mm by 7.5 mm, for example. In one implementation, each adjacent pair of antennas may be separated by a distance of a multiple integer of the quarter wavelength (i.e., $n*\lambda/4$), such as 7.5 mm, 15 mm, 22.5 mm, and etc. In that implementation, each of antenna feed lines 351*a*, 353*a*, 355*a*, 357*a*, 351*b*, 353*b*, 355*b* and 357*b* may each have a length of a multiple integer of the half wavelength (i.e., $n*\lambda/2$), such as 15 mm, 30 mm, 45 mm, and etc.

In the present implementation, antenna panel 302 is a flat panel array employing antennas 311 through 318, where antenna panel 302 is coupled to associated active circuits to form a beam for reception and/or transmission. In one implementation, the beam is formed fully electronically by means of phase and amplitude control circuits associated with antennas 311 through 318. Thus, antenna panel 302 can provide for beamforming without the use of any mechanical parts.

As shown in FIG. 3B, antennas 311A, 312A, 313A, 314A, 315A, 316A, 317A and 318A are arranged in rectangular-configuration 340, where antennas 311A, 312A, 313A, 314A, 315A, 316A, 317A and 318A are symmetrically distributed at the corners and the mid points of the edges of rectangular-configuration 340. Similarly, antennas 311B, 312B, 313B, 314B, 315B, 316B, 317B and 318B are arranged in a rectangular-configuration, where antennas 311B, 312B, 313B, 314B, 315B, 316B, 317B and 318B are symmetrically distributed at the corners and the mid points of the edges of the rectangular-configuration. In the present implementation, the antenna feed lines carry RF analog signals from the antennas to their corresponding RF front end chips. The rectangular-configuration makes it easy for the wireless receiver to rout the signals in a symmetrical way, thereby reducing the overall length of the antenna feed lines and the cross-talk among them. In addition, the rectangular-configuration with symmetric routing can minimize transmission loss and path delays, and increase routing efficiency, especially for antenna panels with hundreds or thousands of antennas.

It is noted that in the present implementation, antennas 311 through 318, and RF front end chips 306A and 306B are formed on the same layer on antenna panel 302. In another implementation, antennas 311 through 318 of the wireless receiver may be formed on antenna panel 302, while RF front end chips 306A and 306B may be formed on another layer below antenna panel 302.

Figure 3C:
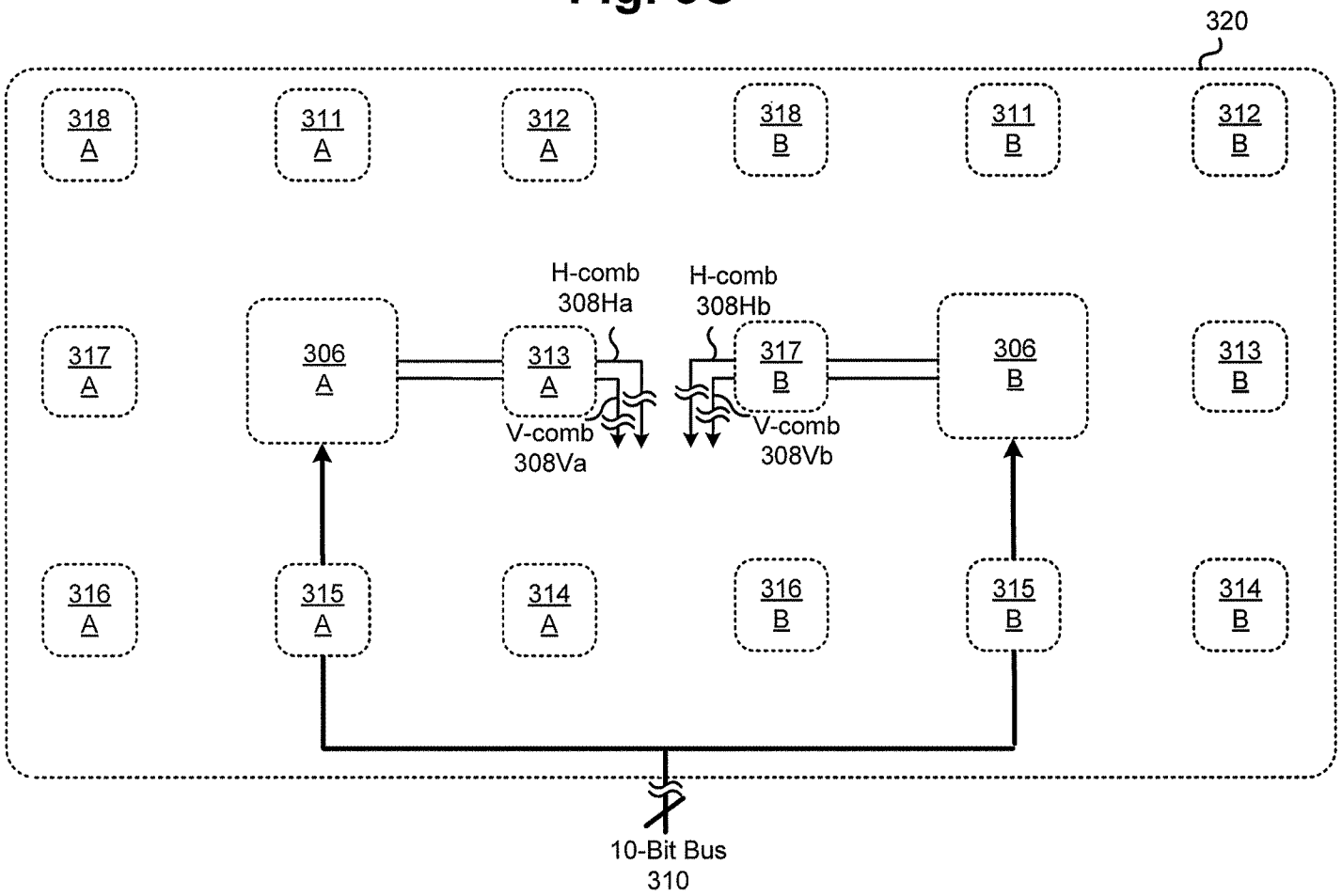
FIG. 3C illustrates a functional block diagram of a portion of an exemplary wireless receiver according to one implementation of the present application.

Referring now to FIG. 3C, FIG. 3C illustrates a functional block diagram of a portion of an exemplary wireless receiver according to one implementation of the present application. In the present implementation, section 320 in FIG. 3C may correspond to section 320 in FIGS. 3A and 3B. As shown in FIG. 3C, RF front end chip 306A combines all of the horizontally-polarized signals, by adding powers and combining phases of the individual horizontally-polarized signals, from antennas 311A, 312A, 313A, 314A, 315A, 316A, 317A and 318A, and provides H-combined output 308Ha to a master chip (not explicitly shown in FIG. 3C). RF front end chip 306A also combines all of the vertically-polarized signals, by adding powers and combining phases of the individual vertically-polarized signals, from antennas 311A, 312A, 313A, 314A, 315A, 316A, 317A and 318A, and provides V-combined output 308Va to the master chip. Similarly, RF front end chip 306B combines all of the horizontally-polarized signals, by adding powers and combining phases of the individual horizontally-polarized signals, from antennas 311B, 312B, 313B, 314B, 315B, 316B, 317B and 318B, and provides H-combined output 308Hb to the master chip. RF front end chip 306B also combines all of the vertically-polarized signals, by adding powers and combining phases of the individual vertically-polarized signals, from antennas 311B, 312B, 313B, 314B, 315B, 316B, 317B and 318B, and provides V-combined output 308Vb to the master chip.

As illustrated in FIG. 3C, control bus 310 is provided, for example, from the master chip to RF front end chips 306A and 306B. In the present implementation, control bus 310 is a ten-bit control bus, for example. Control bus 310 may be configured to provide phase shift signals to one or more phase shifters (not explicitly shown in FIG. 3C) in RF front end chips 306A and 306B, where at least one of the phase shift signals is configured to cause a phase shift in at least one linearly polarized signal received from a corresponding antenna. In addition, control bus 310 may be configured to provide amplitude control signals to one or more amplifiers (not explicitly shown in FIG. 3C) in RF front end chips 306A and 306B, where at least one of the amplitude control signals is configured to cause a change in amplitude in at least one linearly polarized signal received from a corresponding antenna.

Figure 3D:
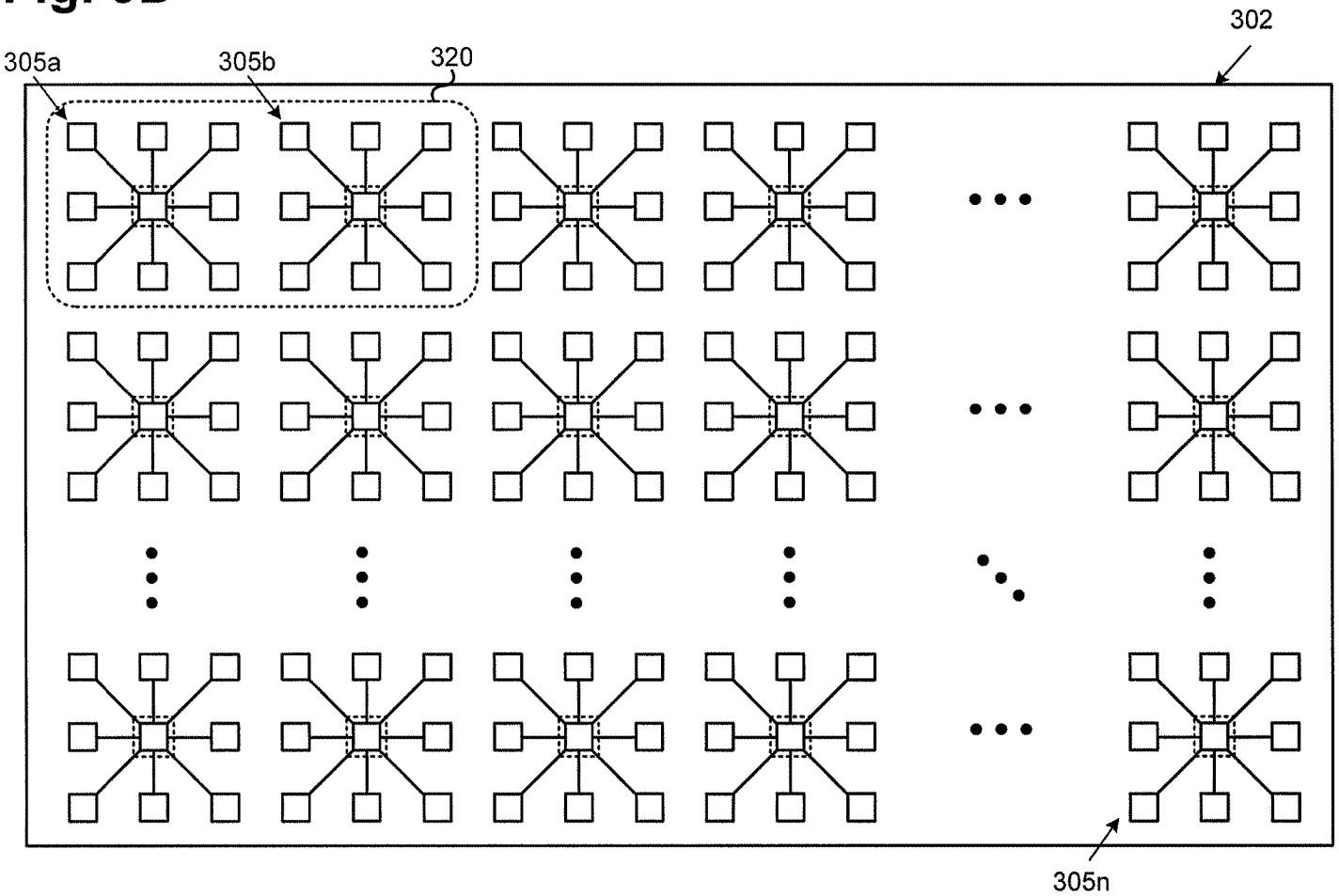
FIG. 3D illustrates a top plan view of a portion of an antenna panel of an exemplary wireless receiver according to one implementation of the present application.
Figure 3E:
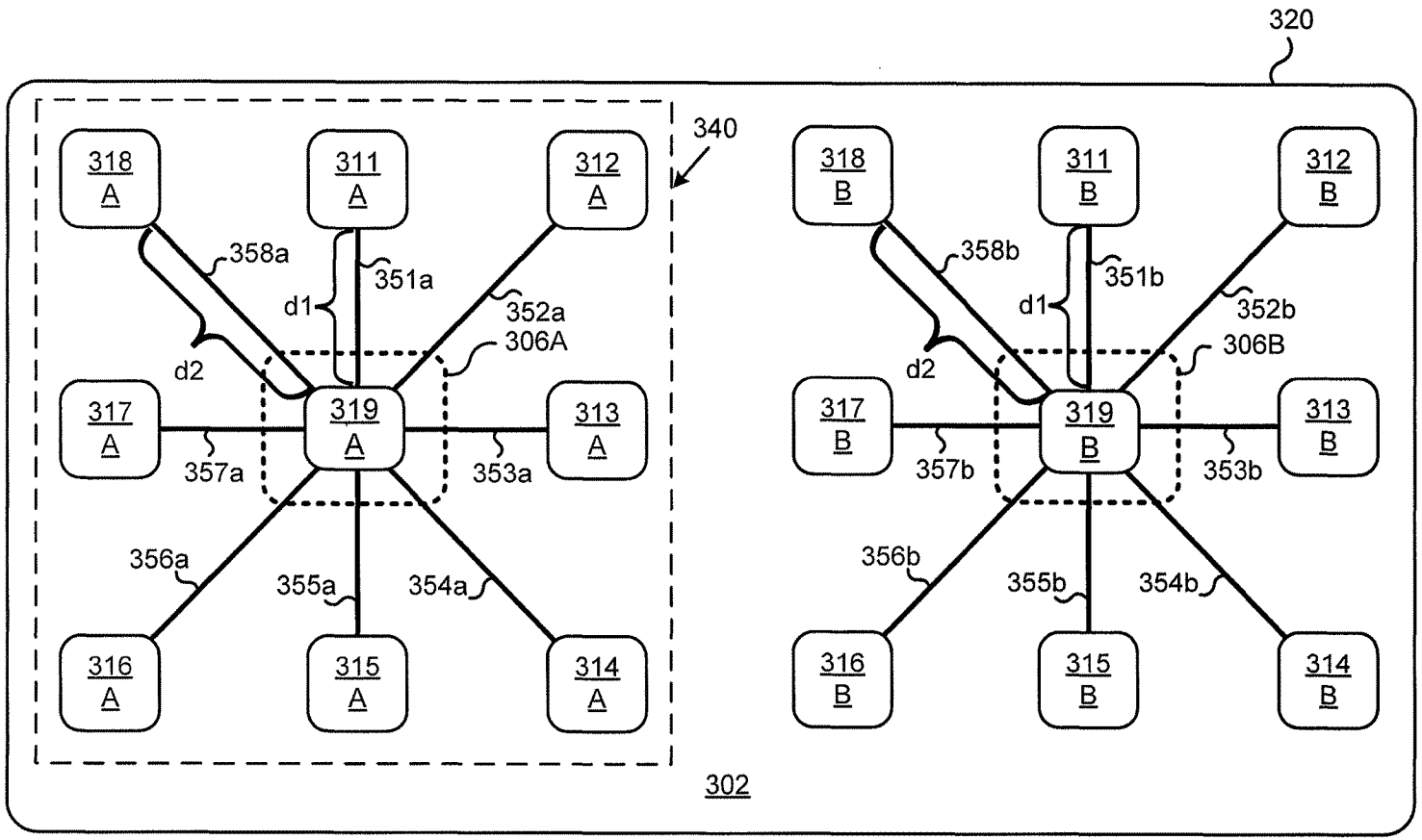
FIG. 3E illustrates a top plan view of a portion of an antenna panel of an exemplary wireless receiver according to one implementation of the present application.
Figure 3F:
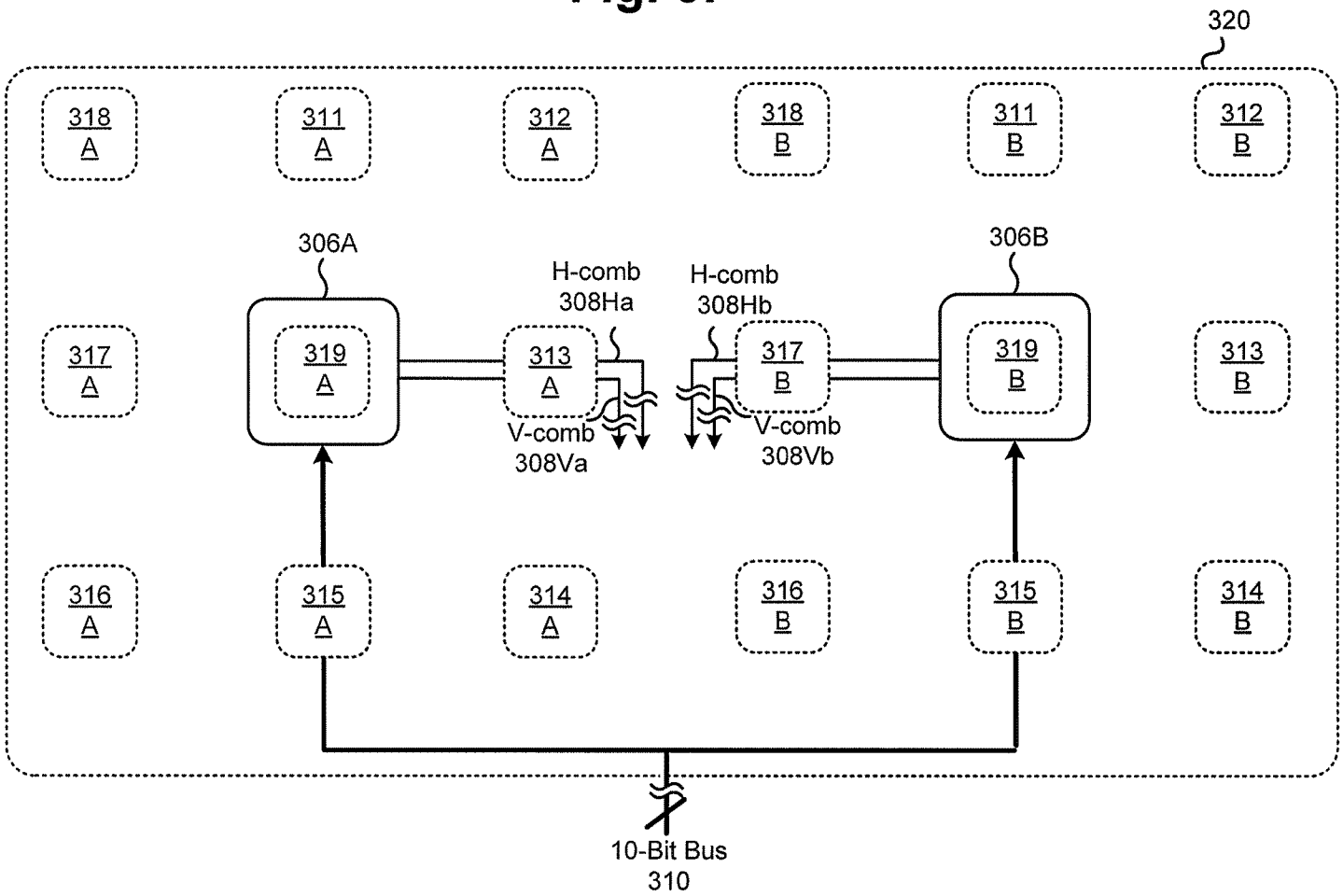
FIG. 3F illustrates a functional block diagram of a portion of an exemplary wireless receiver according to one implementation of the present application.

Referring to FIGS. 3D, 3E and 3F, with similar numerals representing similar features in FIGS. 3A, 3B and 3C, FIGS. 3D, 3E and 3F show an implementation, where each of RF front end units 305*a* through 305*n* includes an additional antenna in the center of the rectangular-configuration. Thus, each of RF front end units 305*a* through 305*n* includes a group of nine antennas. It is noted that in the implementation shown in FIGS. 3D, 3E and 3F, the RF front end chips are each situated below the additional antenna in the center of the rectangular-configuration. For example, antenna panel 302 may be a part of a multi-layer PCB having at least two layers, where antennas 311A, 312A, 313A, 314A, 315A, 316A, 317A, 318A, 319A, 311B, 312B, 313B, 314B, 315B, 316B, 317B, 318B and 319B are situated on antenna panel 302, as a top layer of the multi-layer PCB, while RF front end chips 306A and 306B are situated in another layer of the multi-layer PCB below the top layer. As shown in FIGS. 3D, 3E and 3F, RF front end chips 306A and 306B are situated directly below antennas 319A and 319B, respectively.

Figure 4A:
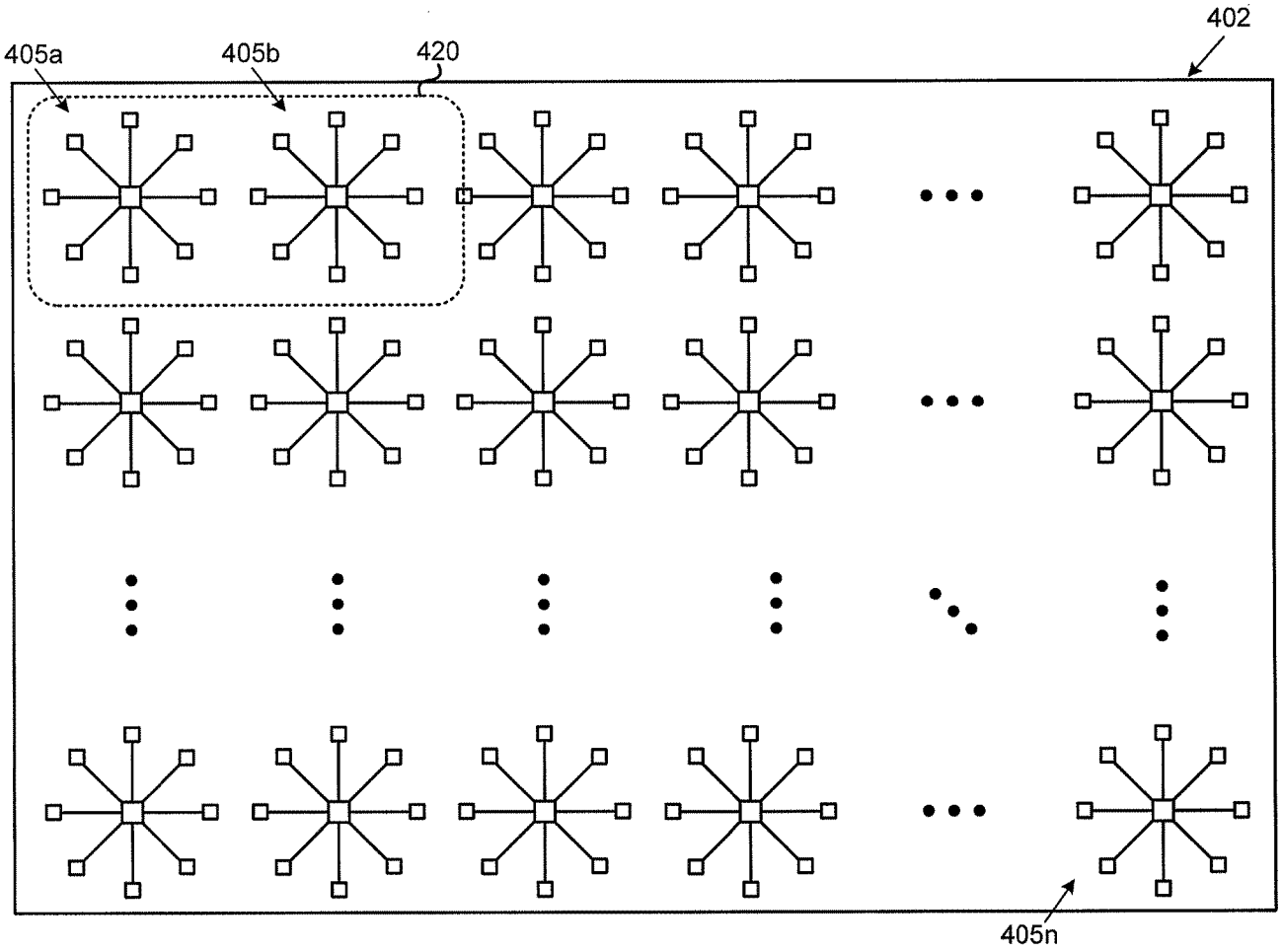
FIG. 4A illustrates a top plan view of a portion of an antenna panel of an exemplary wireless receiver according to one implementation of the present application.
Figure 4B:
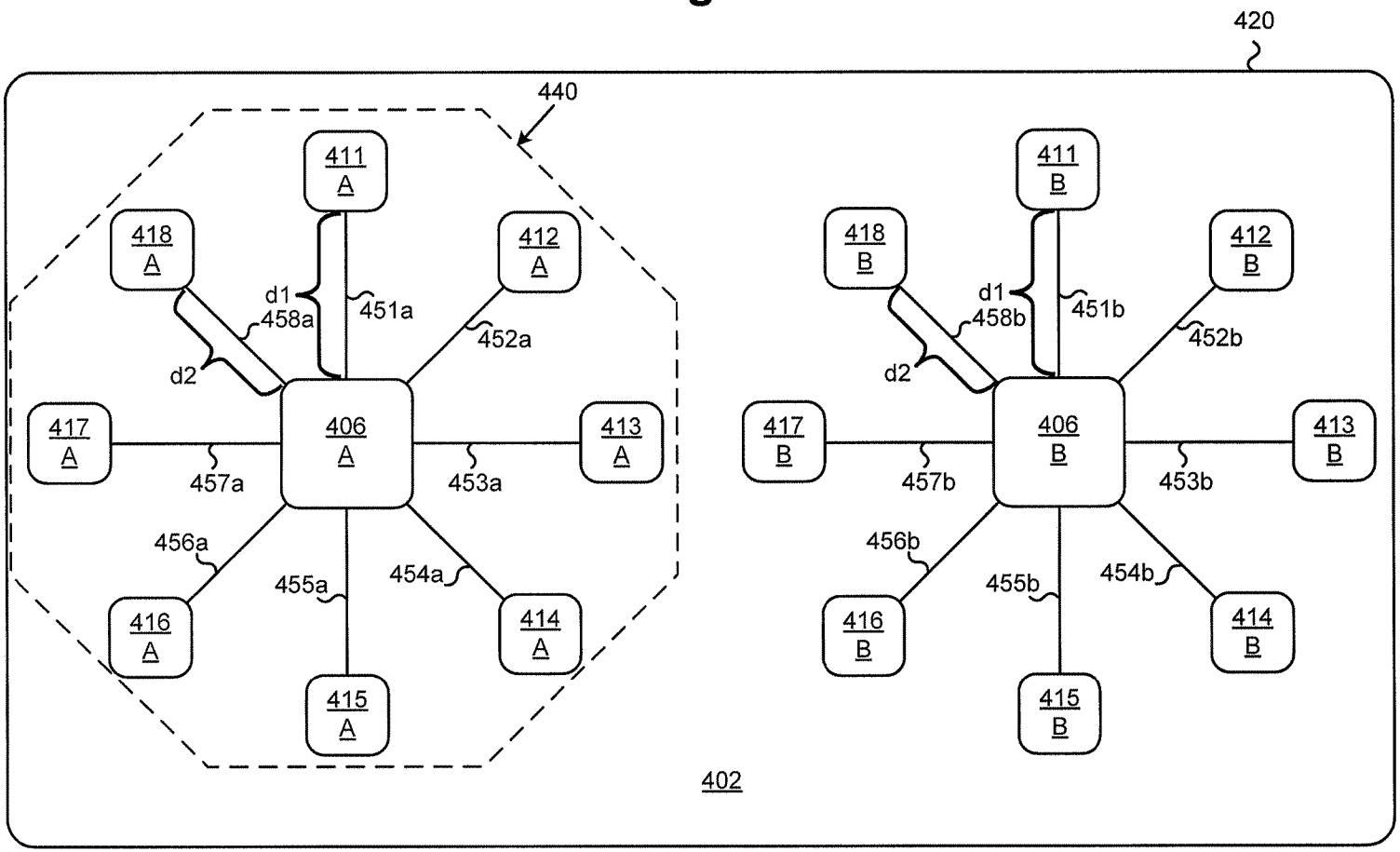
FIG. 4B illustrates a top plan view of a portion of an antenna panel of an exemplary wireless receiver according to one implementation of the present application.

Referring now to FIGS. 4A and 4B, FIG. 4A illustrates a top plan view of a portion of an antenna panel of an exemplary wireless receiver according to one implementation of the present application. FIG. 4B illustrates a section of the antenna panel in FIG. 4A. As illustrated in FIG. 4A, antenna panel 402 includes a plurality of RF front end units 405*a*, 405*b* through 405*n*. Each of RF front end units 405*a*, 405*b* through 405*n* includes an RF front end chip surrounded by a group of eight antennas arranged in an octagonal-configuration.

FIG. 4B shows an enlarged view of section 420 of antenna panel 402 in FIG. 4A. As illustrated in FIG. 4B, RF front end chip 406A is surrounded by a group of eight antennas, namely, antennas 411A, 412A, 413A, 414A, 415A, 416A, 417A and 418A. RF front end chip 406A and antennas 411A, 412A, 413A, 414A, 415A, 416A, 417A and 418A may correspond to RF front end unit 405*a* in FIG. 4A. Antennas 411A, 412A, 413A, 414A, 415A, 416A, 417A and 418A are coupled to RF front end chip 406A through antenna feed lines 451*a*, 452*a*, 453*a*, 454*a*, 455*a*, 456*a*, 457*a* and 458*a*, respectively. In the present implementation, antenna feed lines 451*a*, 453*a*, 455*a* and 457*a* may each have length d1, while antenna feed lines 452*a*, 454*a*, 456*a* and 458*a* may each have length d2. In one implementation, length d1 is equal to length d2. In one implementation each feed line 451*a*, 452*a*, 453*a*, 454*a*, 455*a*, 456*a*, 457*a* and 458*a* includes a pair of lines such that one line in the pair would carry a horizontally-polarized signal while the other line in the pair would carry a vertically-polarized signal. However, for ease of illustration, each pair is shown as a single feed line, such as feed line 451*a*, even for implementations that a pair of lines are represented by each feed line.

Similarly, RF front end chip 406B is surrounded by a group of eight antennas, namely, antennas 411B, 412B, 413B, 414B, 415B, 416B, 417B and 418B. RF front end chip 406B and antennas 411B, 412B, 413B, 414B, 415B, 416B, 417B and 418B may correspond to RF front end unit 405*b* in FIG. 4A. Antennas 411B, 412B, 413B, 414B, 415B, 416B, 417B and 418B are coupled to RF front end chip 406B through antenna feed lines 451*b*, 452*b*, 453*b*, 454*b*, 455*b*, 456*b*, 457*b* and 458*b*, respectively. In the present implementation, antenna feed lines 451*b*, 453*b*, 455*b* and 457*b* may each have length d1, while antenna feed lines 452*b*, 454*b*, 456*b* and 458*b* may each have length d2. In one implementation, length d1 is equal to length d2. In one implementation each feed line 451*b*, 452*b*, 453*b*, 454*b*, 455*b*, 456*b*, 457*b* and 458*b* includes a pair of lines such that one line in the pair would carry a horizontally-polarized signal while the other line in the pair would carry a vertically-polarized signal. However, for ease of illustration, each pair is shown as a single feed line, such as feed line 451*b*, even for implementations that a pair of lines are represented by each feed line.

In one implementation, antennas 411A, 412A, 413A, 414A, 415A, 416A, 417A, 418A, 411B, 412B, 413B, 414B, 415B, 416B, 417B and 418B, and the other antennas (collectively referred to as antennas 411 through 418) on antenna panel 402 as shown in FIG. 4A, may be configured to receive signals from one or more wireless transmitters, such as commercial geostationary communication satellites or low earth orbit satellites having a very large bandwidth in the 10 GHz to 20 GHz frequency range and a very high data rate. In another implementation, antennas 411 through 418 on antenna panel 402 may be configured to receive signals in the 60 GHz frequency range, sometimes referred to as "60 GHz communications," which involve transmission and reception of millimeter wave signals. Among the applications for 60 GHz communications are wireless personal area networks, wireless high-definition television signal and Point-to-Point links.

In one implementation, for a wireless transmitter transmitting signals at 10 GHz (i.e., $\lambda$=30 mm), each antenna in antenna panel 402 in a wireless receiver needs an area of at least a quarter wavelength (e.g., λ/4=7.5 mm) by a quarter wavelength (e.g., λ/4=7.5 mm) to receive the transmitted signals. As illustrated in FIGS. 4A and 4B, antennas 411 through 418 in antenna panel 402 may each have a substantially square shape having dimensions of 7.5 mm by 7.5 mm, for example. In one implementation, each adjacent pair of antennas may be separated by a distance of a multiple integer of the quarter wavelength (i.e., n*λ/4), such as 7.5 mm, 15 mm, 22.5 mm, and etc. In that implementation, each of antenna feed lines 451*a*, 452*a*, 453*a*, 454*a*, 455*a*, 456*a*, 457*a*, 458*a*, 451*b*, 452*b*, 453*b*, 454*b*, 455*b*, 456*b*, 457*b* and 458*b* may each have a length of a multiple integer of the half wavelength (i.e., n*λ/2), such as 15 mm, 30 mm, 45 mm, and etc.

In the present implementation, antenna panel 402 is a flat panel array employing antennas 411 through 418, where antenna panel 402 is coupled to associated active circuits to form a beam for reception and/or transmission. In one implementation, the beam is formed fully electronically by means of phase and amplitude control circuits associated with antennas 411 through 418. Thus, antenna panel 402 can provide for beamforming without the use of any mechanical parts.

As shown in FIG. 4B, antennas 411A, 412A, 413A, 414A, 415A, 416A, 417A and 418A are arranged in octagonal-configuration 440, where antennas 411A, 412A, 413A, 414A, 415A, 416A, 417A and 418A are symmetrically distributed at each vertex of a regular octagon in octagonal-configuration 440. Similarly, antennas 411B, 412B, 413B, 414B, 415B, 416B, 417B and 418B are arranged in an octagonal-configuration, where antennas 411B, 412B, 413B, 414B, 415B, 416B, 417B and 418B are symmetrically distributed at each vertex of a regular octagon in the octagonal-configuration. In the present implementation, the antenna feed lines carry RF analog signals from the antennas to their corresponding RF front end chips. The octagonal-configuration makes it easy for the wireless receiver to rout the signals in a symmetrical way, thereby reducing the overall length of the antenna feed lines and the cross-talk among them. In addition, the octagonal-configuration with symmetric routing can minimize transmission loss and path delays, and increase routing efficiency, especially for antenna panels with hundreds or thousands of antennas.

It is noted that in the present implementation, antennas 411 through 418, and RF front end chips 406A and 406B are formed on the same layer on antenna panel 402. In another implementation, antennas 411 through 418 of the wireless receiver may be formed on antenna panel 402, while RF front end chips 406A and 406B may be formed on another layer below antenna panel 402.

Figure 4C:
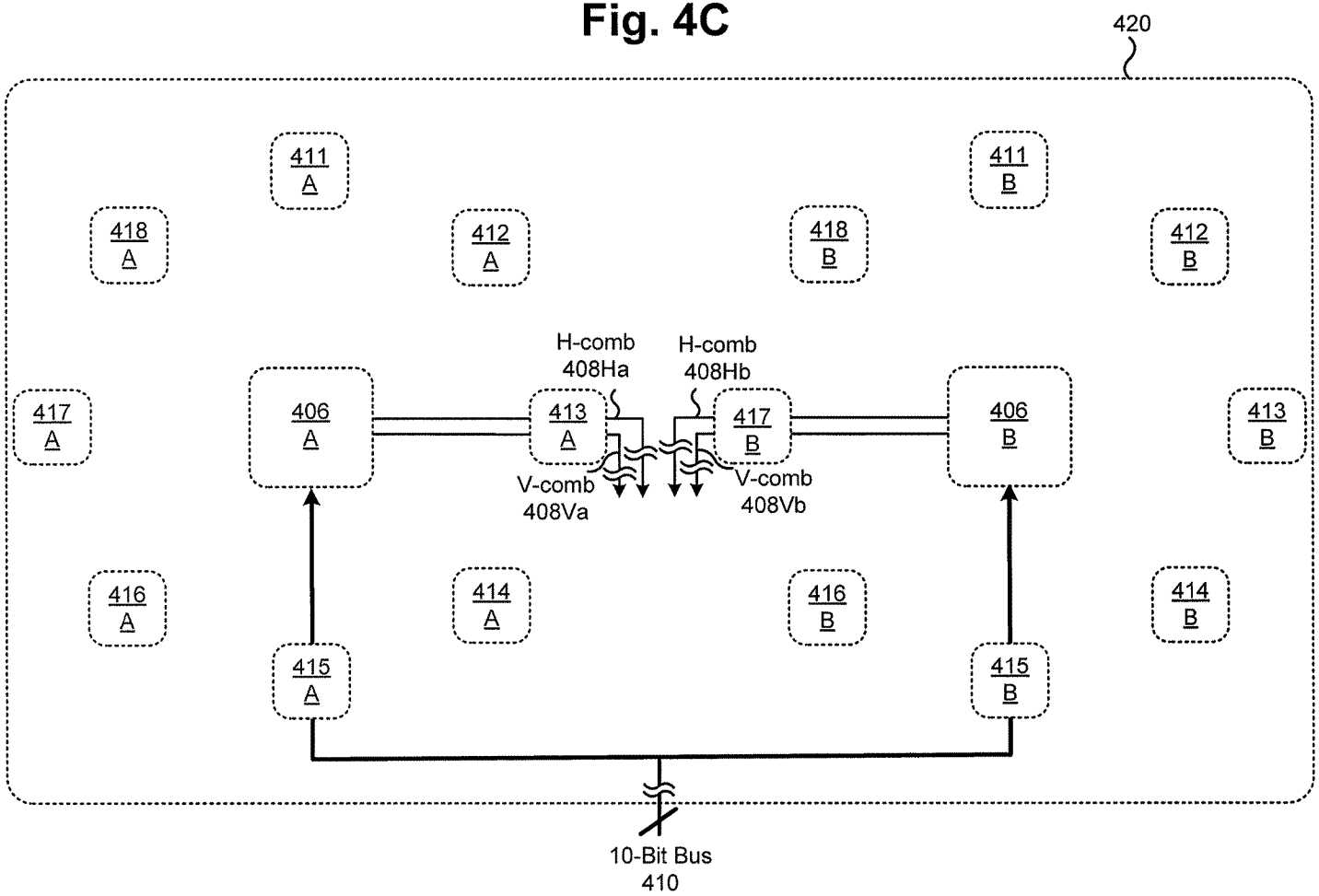
FIG. 4C illustrates a functional block diagram of a portion of an exemplary wireless receiver according to one implementation of the present application.

Referring now to FIG. 4C, FIG. 4C illustrates a functional block diagram of a portion of an exemplary wireless receiver according to one implementation of the present application. In the present implementation, section 420 in FIG. 4C may correspond to section 420 in FIGS. 4A and 4B. As shown in FIG. 4C, RF front end chip 406A combines all of the horizontally-polarized signals, by adding powers and combining phases of the individual horizontally-polarized signals, from antennas 411A, 412A, 413A, 414A, 415A, 416A, 417A and 418A, and provides H-combined output 408Ha to a master chip (not explicitly shown in FIG. 4C). RF front end chip 406A also combines all of the vertically-polarized signals, by adding powers and combining phases of the individual vertically-polarized signals, from antennas 411A, 412A, 413A, 414A, 415A, 416A, 417A and 418A, and provides V-combined output 408Va to the master chip. Similarly, RF front end chip 406B combines all of the horizontally-polarized signals, by adding powers and combining phases of the individual horizontally-polarized signals, from antennas 411B, 412B, 413B, 414B, 415B, 416B, 417B and 418B, and provides H-combined output 408Hb to the master chip. RF front end chip 406B also combines all of the vertically-polarized signals, by adding powers and combining phases of the individual vertically-polarized signals, from antennas 411B, 412B, 413B, 414B, 415B, 416B, 417B and 418B, and provides V-combined output 408Vb to the master chip.

As illustrated in FIG. 4C, control bus 410 is provided, for example, from the master chip to RF front end chips 406A and 406B. In the present implementation, control bus 410 is a ten-bit control bus, for example. Control bus 410 may be configured to provide phase shift signals to one or more phase shifters (not explicitly shown in FIG. 4C) in RF front end chips 406A and 406B, where at least one of the phase shift signals is configured to cause a phase shift in at least one linearly polarized signal received from a corresponding antenna. In addition, control bus 410 may be configured to provide amplitude control signals to one or more amplifiers (not explicitly shown in FIG. 4C) in RF front end chips 406A and 406B, where at least one of the amplitude control signals is configured to cause a change in amplitude in at least one linearly polarized signal received from a corresponding antenna.

Figure 4D:
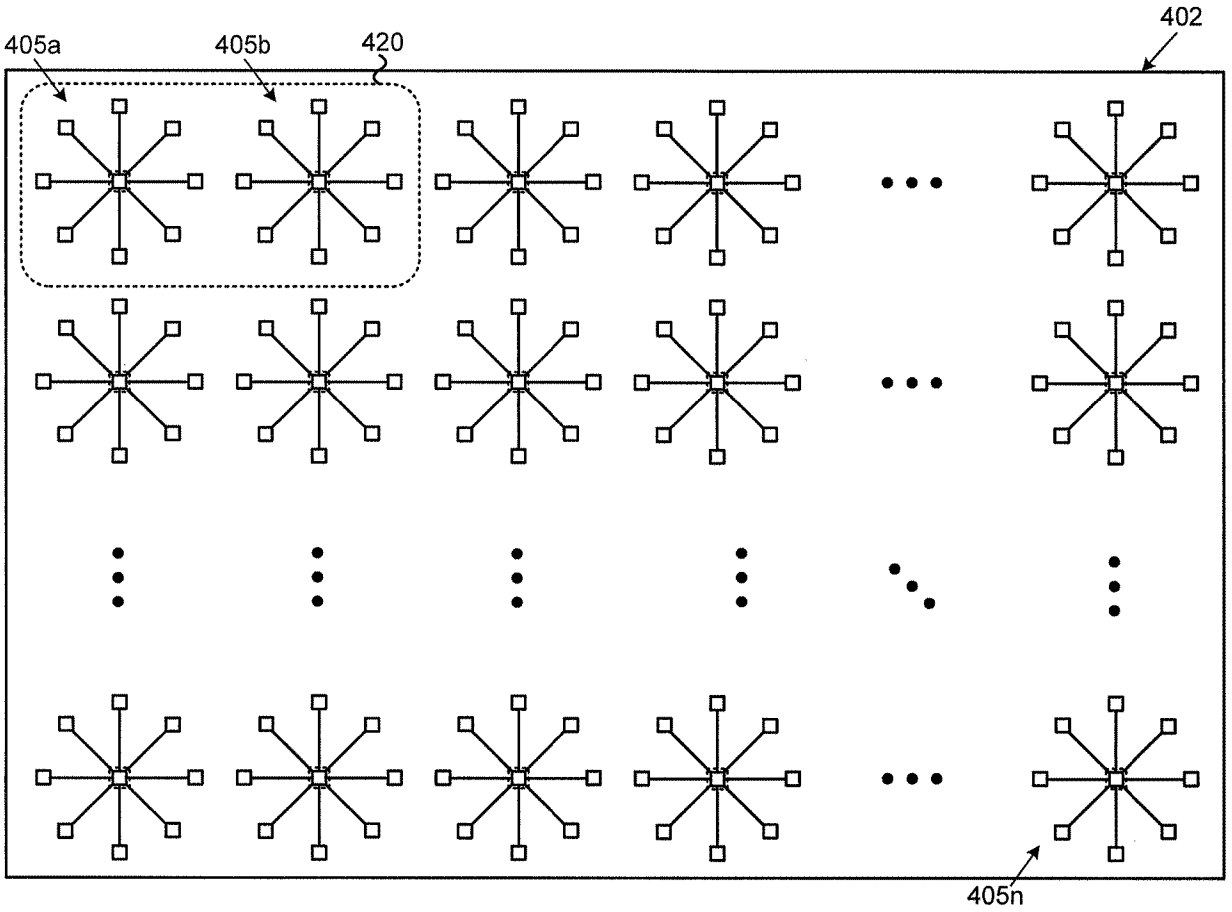
FIG. 4D illustrates a top plan view of a portion of an antenna panel of an exemplary wireless receiver according to one implementation of the present application.
Figure 4E:
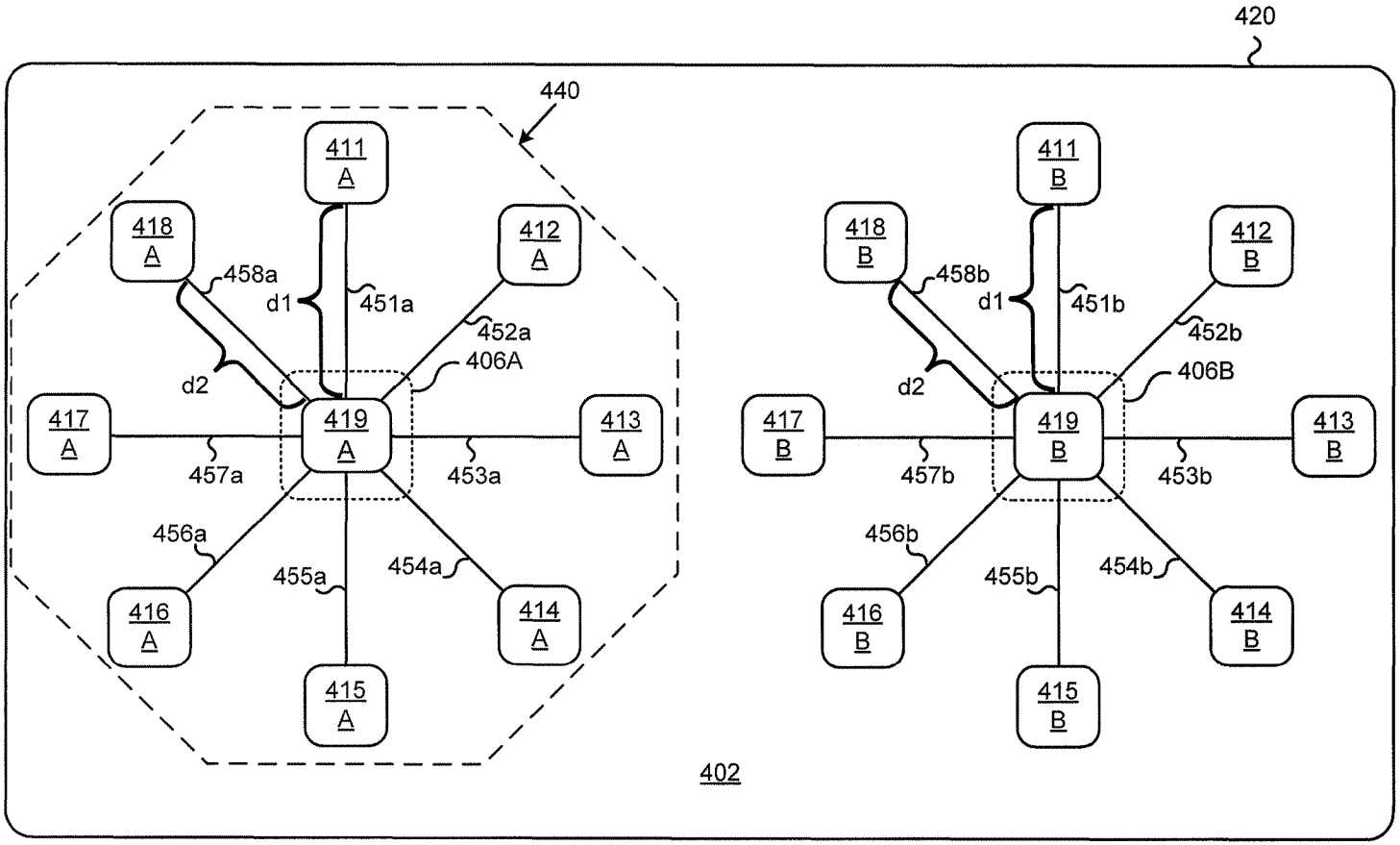
FIG. 4E illustrates a top plan view of a portion of an antenna panel of an exemplary wireless receiver according to one implementation of the present application.
Figure 4F:
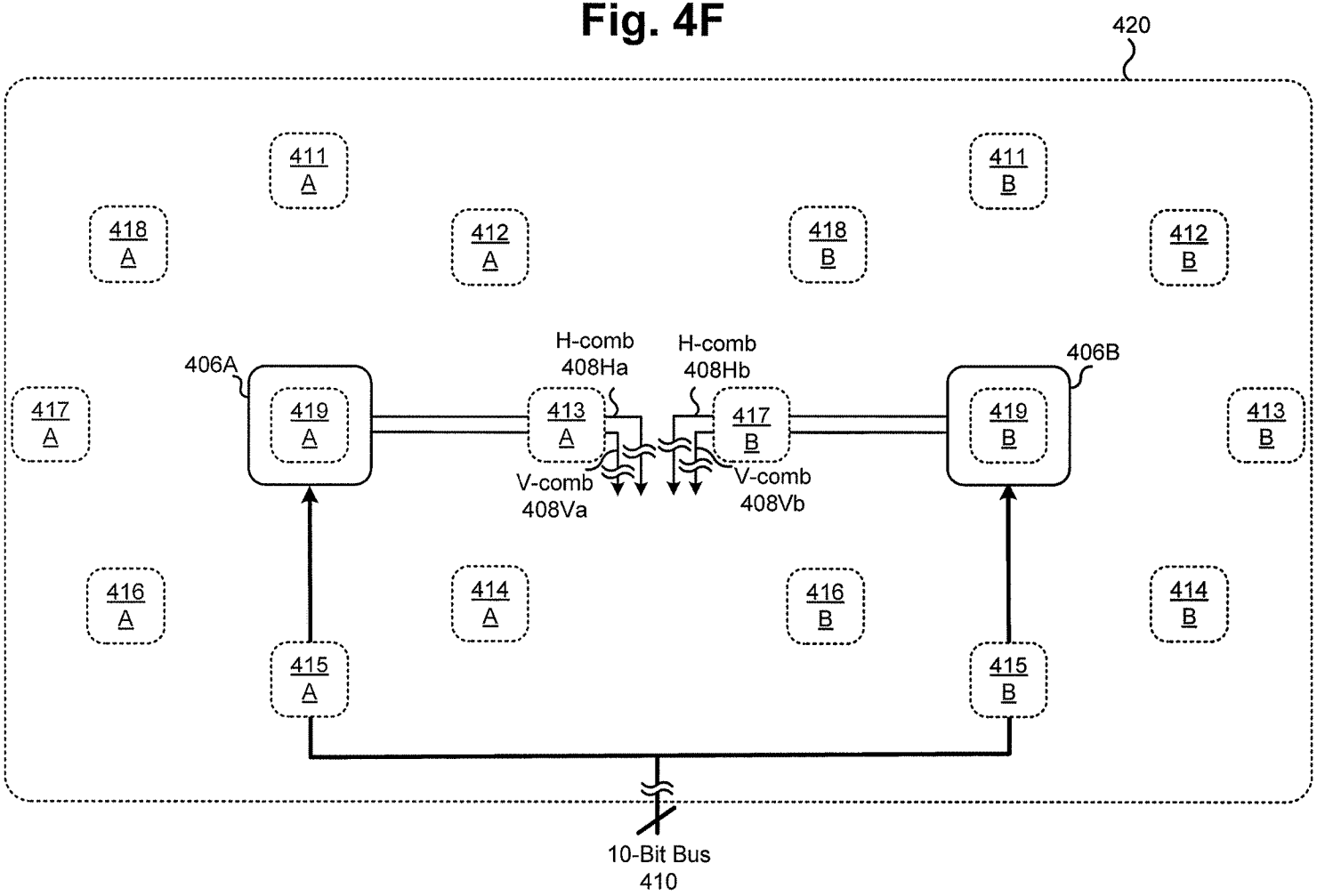
FIG. 4F illustrates a functional block diagram of a portion of an exemplary wireless receiver according to one implementation of the present application.

Referring to FIGS. 4D, 4E and 4F, with similar numerals representing similar features in FIGS. 4A, 4B and 4C, FIGS. 4D, 4E and 4F show an implementation, where each of RF front end units 405*a* through 405*n* includes an additional antenna in the center of the octagonal-configuration. Thus, each of RF front end units 405*a* through 405*n* includes a group of nine antennas. It is noted that in the implementation shown in FIGS. 4D, 4E and 4F, the RF front end chips are each situated below the additional antenna in the center of the octagonal-configuration. For example, antenna panel 402 may be a part of a multi-layer PCB having at least two layers, where antennas 411A, 412A, 413A, 414A, 415A, 416A, 417A, 418A, 419A, 411B, 412B, 413B, 414B, 415B, 416B, 417B, 418B and 419B are situated on antenna panel 402, as a top layer of the multi-layer PCB, while RF front end chips 406A and 406B are situated in another layer of the multi-layer PCB below the top layer. As shown in FIGS. 4D, 4E and 4F, RF front end chips 406A and 406B are situated directly below antennas 419A and 419B, respectively.

Figure 5A:
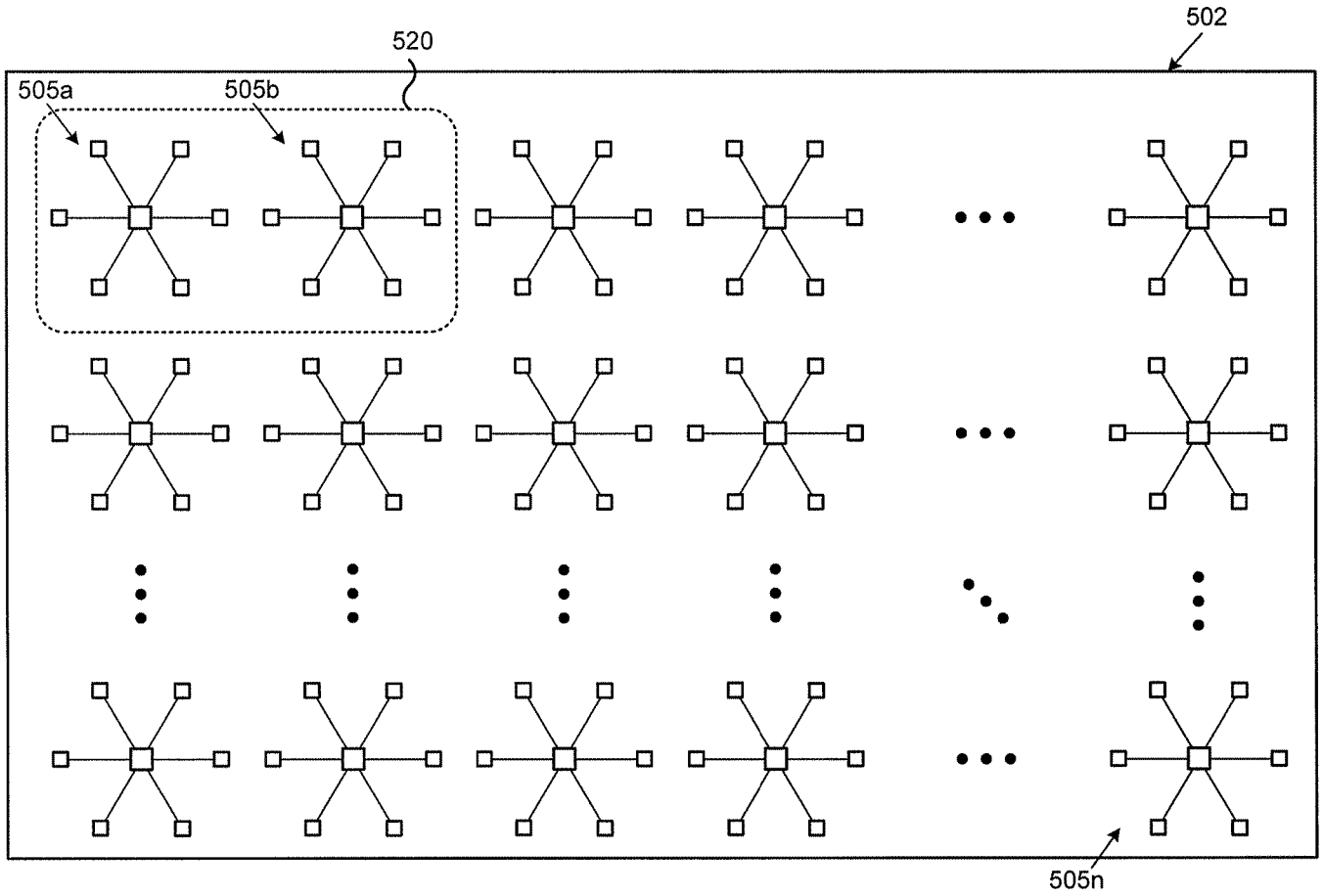
FIG. 5A illustrates a top plan view of a portion of an antenna panel of an exemplary wireless receiver according to one implementation of the present application.
Figure 5B:
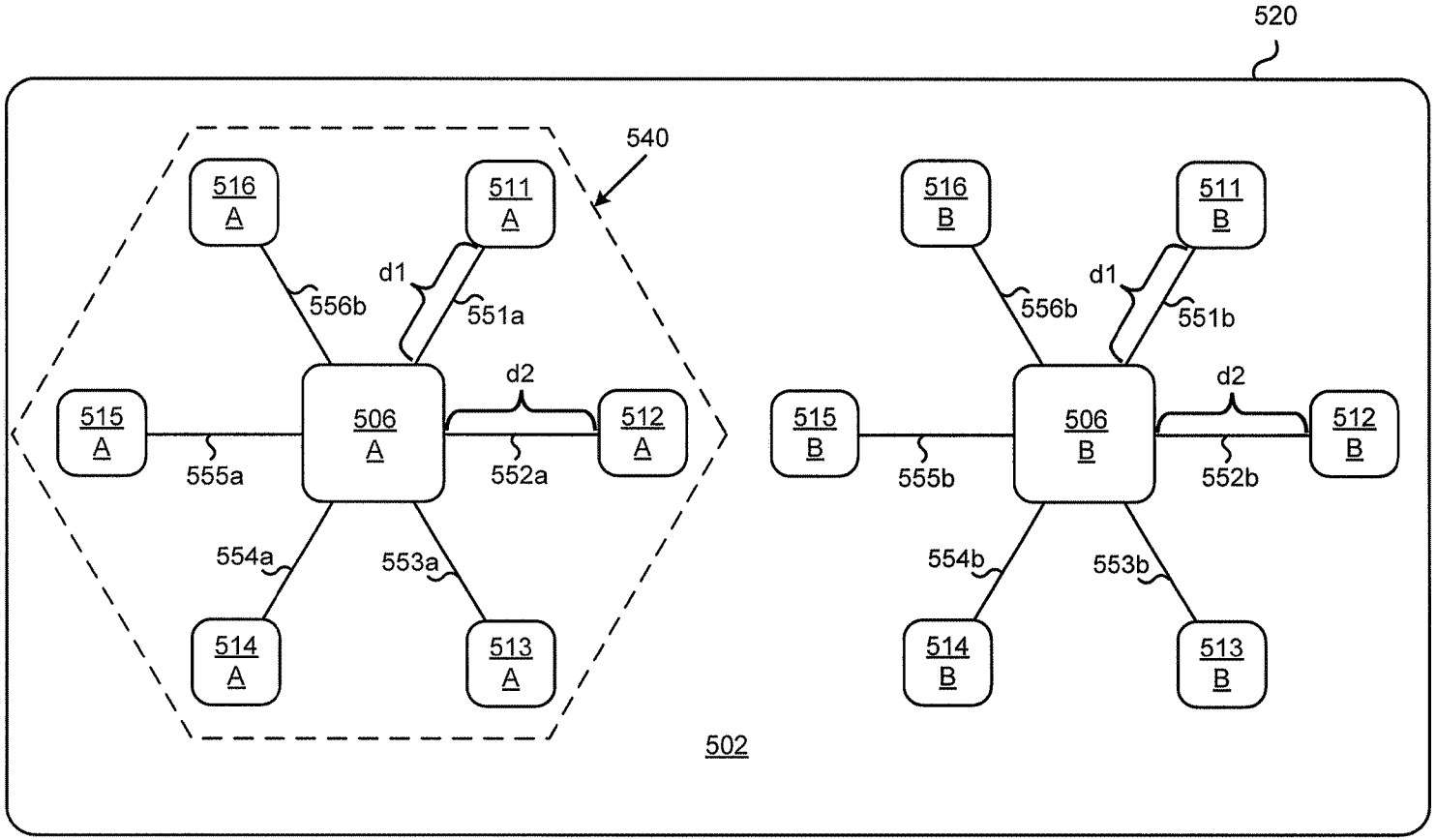
FIG. 5B illustrates a top plan view of a portion of an antenna panel of an exemplary wireless receiver according to one implementation of the present application.

Referring now to FIGS. 5A and 5B, FIG. 5A illustrates a top plan view of a portion of an antenna panel of an exemplary wireless receiver according to one implementation of the present application. FIG. 5B illustrates a section of the antenna panel in FIG. 5A. As illustrated in FIG. 5A, antenna panel 502 includes a plurality of RF front end units 505*a*, 505*b* through 505*n*. Each of RF front end units 505*a*, 505*b* through 505*n* includes an RF front end chip surrounded by a group of six antennas arranged in a hexagonal-configuration.

FIG. 5B shows an enlarged view of section 520 of antenna panel 502 in FIG. 5A. As illustrated in FIG. 5B, RF front end chip 506A is surrounded by a group of six antennas, namely, antennas 511A, 512A, 513A, 514A, 515A and 516A. RF front end chip 506A and antennas 511A, 512A, 513A, 514A, 515A and 516A may correspond to RF front end unit 505*a* in FIG. 5A. Antennas 511A, 512A, 513A, 514A, 515A and 516A are coupled to RF front end chip 506A through antenna feed lines 551*a*, 552*a*, 553*a*, 554*a*, 555*a* and 556*a*, respectively. In the present implementation, antenna feed lines 551*a*, 553*a* and 555*a* may each have length d1, while antenna feed lines 552*a*, 554*a* and 556*a* may each have length d2. In one implementation, length d1 is equal to length d2. In one implementation each feed line 551*a*, 552*a*, 553*a*, 554*a*, 555*a* and 556*a* includes a pair of lines such that one line in the pair would carry a horizontally-polarized signal while the other line in the pair would carry a vertically-polarized signal. However, for ease of illustration, each pair is shown as a single feed line, such as feed line 551*a*, even for implementations that a pair of lines are represented by each feed line.

Similarly, RF front end chip 506B is surrounded by a group of six antennas, namely, antennas 511B, 512B, 513B, 514B, 515B and 516B. RF front end chip 506B and antennas 511B, 512B, 513B, 514B, 515B and 516B may correspond to RF front end unit 505*b* in FIG. 5A. Antennas 511B, 512B, 513B, 514B, 515B and 516B are coupled to RF front end chip 506B through antenna feed lines 551*b*, 552*b*, 553*b*, 554*b*, 555*b* and 556*b*, respectively. In the present implementation, antenna feed lines 551*b*, 553*b* and 555*b* may each have length d1, while antenna feed lines 552*b*, 554*b* and 556*b* may each have length d2. In one implementation, length d1 is equal to length d2. In one implementation each feed line 551*b*, 552*b*, 553*b*, 554*b*, 555*b* and 556*b* includes a pair of lines such that one line in the pair would carry a horizontally-polarized signal while the other line in the pair would carry a vertically-polarized signal. However, for ease of illustration, each pair is shown as a single feed line, such as feed line 551*b*, even for implementations that a pair of lines are represented by each feed line.

In one implementation, antennas 511A, 512A, 513A, 514A, 515A, 516A, 511B, 512B, 513B, 514B, 515B and 516B, and the other antennas (collectively referred to as antennas 511 through 516) on antenna panel 502 as shown in FIG. 5A, may be configured to receive signals from one or more wireless transmitters, such as commercial geostationary communication satellites or low earth orbit satellites having a very large bandwidth in the 10 GHz to 20 GHz frequency range and a very high data rate. In another implementation, antennas 511 through 516 on antenna panel 502 may be configured to receive signals in the 60 GHz frequency range, sometimes referred to as "60 GHz communications," which involve transmission and reception of millimeter wave signals. Among the applications for 60 GHz communications are wireless personal area networks, wireless high-definition television signal and Point-to-Point links.

In one implementation, for a wireless transmitter transmitting signals at 10 GHz (i.e., k=30 mm), each antenna in antenna panel 502 in a wireless receiver needs an area of at least a quarter wavelength (e.g., $\lambda/4=7.5$ mm) by a quarter wavelength (e.g., $\lambda/4=7.5$ mm) to receive the transmitted signals. As illustrated in FIGS. 5A and 5B, antennas 511 through 516 in antenna panel 502 may each have a substantially square shape having dimensions of 7.5 mm by 7.5 mm, for example. In one implementation, each adjacent pair of antennas may be separated by a distance of a multiple integer of the quarter wavelength (i.e., $n*\lambda/4$), such as 7.5 mm, 15 mm, 22.5 mm, and etc. In that implementation, each of antenna feed lines 551*a*, 552*a*, 553*a*, 554*a*, 555*a*, 556*a*, 551*b*, 552*b*, 553*b*, 554*b*, 555*b* and 556*b* may each have a length of a multiple integer of the half wavelength (i.e., $n*\lambda/2$), such as 15 mm, 30 mm, 45 mm, and etc.

In the present implementation, antenna panel 502 is a flat panel array employing antennas 511 through 516, where antenna panel 502 is coupled to associated active circuits to form a beam for reception and/or transmission. In one implementation, the beam is formed fully electronically by means of phase and amplitude control circuits associated with antennas 511 through 516. Thus, antenna panel 502 can provide for beamforming without the use of any mechanical parts.

As shown in FIG. 5B, antennas 511A, 512A, 513A, 514A, 515A and 516A are arranged in hexagonal-configuration 540, where antennas 511A, 512A, 513A, 514A, 515A and 516A are symmetrically distributed at each vertex of a regular hexagon in hexagonal-configuration 540. Similarly, antennas 511B, 512B, 513B, 514B, 515B and 516B are arranged in a hexagonal-configuration, where antennas 511B, 512B, 513B, 514B, 515B, 516B, 517B and 518B are symmetrically distributed at each vertex of a regular hexagon in the hexagonal-configuration. In the present implementation, the antenna feed lines carry RF analog signals from the antennas to their corresponding RF front end chips. The hexagonal-configuration makes it easy for the wireless receiver to rout the signals in a symmetrical way, thereby reducing the overall length of the antenna feed lines and the cross-talk among them. In addition, the hexagonal-configuration with symmetric routing can minimize transmission loss and path delays, and increase routing efficiency, especially for antenna panels with hundreds or thousands of antennas.

It is noted that in the present implementation, antennas 511 through 516, and RF front end chips 506A and 506B are formed on the same layer on antenna panel 502. In another implementation, antennas 511 through 516 of the wireless receiver may be formed on antenna panel 502, while RF front end chips 506A and 506B may be formed on another layer below antenna panel 502.

Figure 5C:
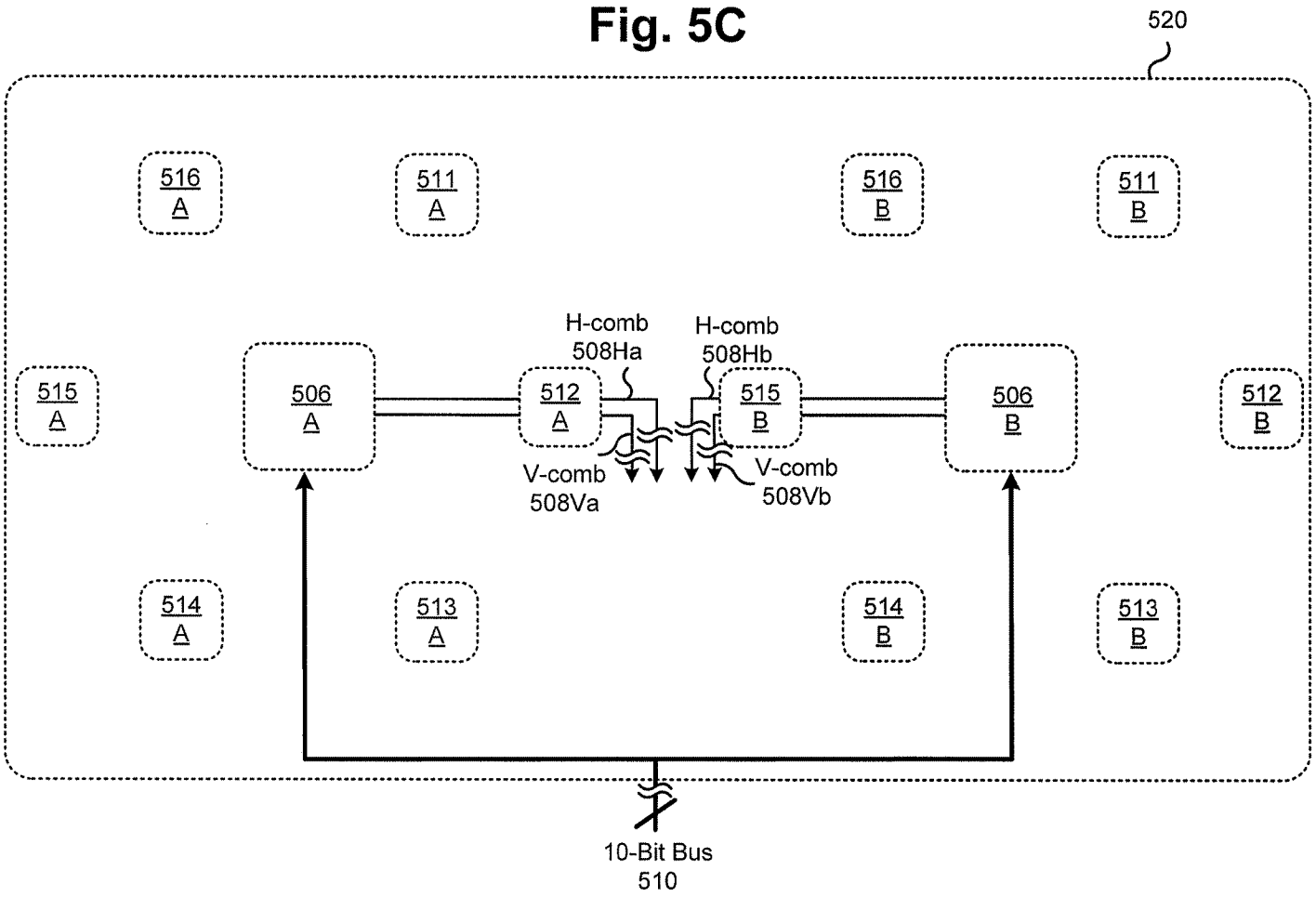
FIG. 5C illustrates a functional block diagram of a portion of an exemplary wireless receiver according to one implementation of the present application.

Referring now to FIG. 5C, FIG. 5C illustrates a functional block diagram of a portion of an exemplary wireless receiver according to one implementation of the present application. In the present implementation, section 520 in FIG. 5C may correspond to section 520 in FIGS. 5A and 5B. As shown in FIG. 5C, RF front end chip 506A combines all of the horizontally-polarized signals, by adding powers and combining phases of the individual horizontally-polarized signals, from antennas 511A, 512A, 513A, 514A, 515A and 516A, and provides H-combined output 508Ha to a master chip (not explicitly shown in FIG. 5C). RF front end chip 506A also combines all of the vertically-polarized signals, by adding powers and combining phases of the individual vertically-polarized signals, from antennas 511A, 512A, 513A, 514A, 515A and 516A, and provides V-combined output 508Va to the master chip. Similarly, RF front end chip 506B combines all of the horizontally-polarized signals, by adding powers and combining phases of the individual horizontally-polarized signals, from antennas 511B, 512B, 513B, 514B, 515B and 516B, and provides H-combined output 508Hb to the master chip. RF front end chip 506B also combines all of the vertically-polarized signals, by adding powers and combining phases of the individual vertically-polarized signals, from antennas 511B, 512B, 513B, 514B, 515B, and 516B, and provides V-combined output 508Vb to the master chip.

As illustrated in FIG. 5C, control bus 510 is provided, for example, from the master chip to RF front end chips 506A and 506B. In the present implementation, control bus 510 is a ten-bit control bus, for example. Control bus 510 may be configured to provide phase shift signals to one or more phase shifters (not explicitly shown in FIG. 5C) in RF front end chips 506A and 506B, where at least one of the phase shift signals is configured to cause a phase shift in at least one linearly polarized signal received from a corresponding antenna. In addition, control bus 510 may be configured to provide amplitude control signals to one or more amplifiers (not explicitly shown in FIG. 5C) in RF front end chips 506A and 506B, where at least one of the amplitude control signals is configured to cause a change in amplitude in at least one linearly polarized signal received from a corresponding antenna.

Figure 5D:
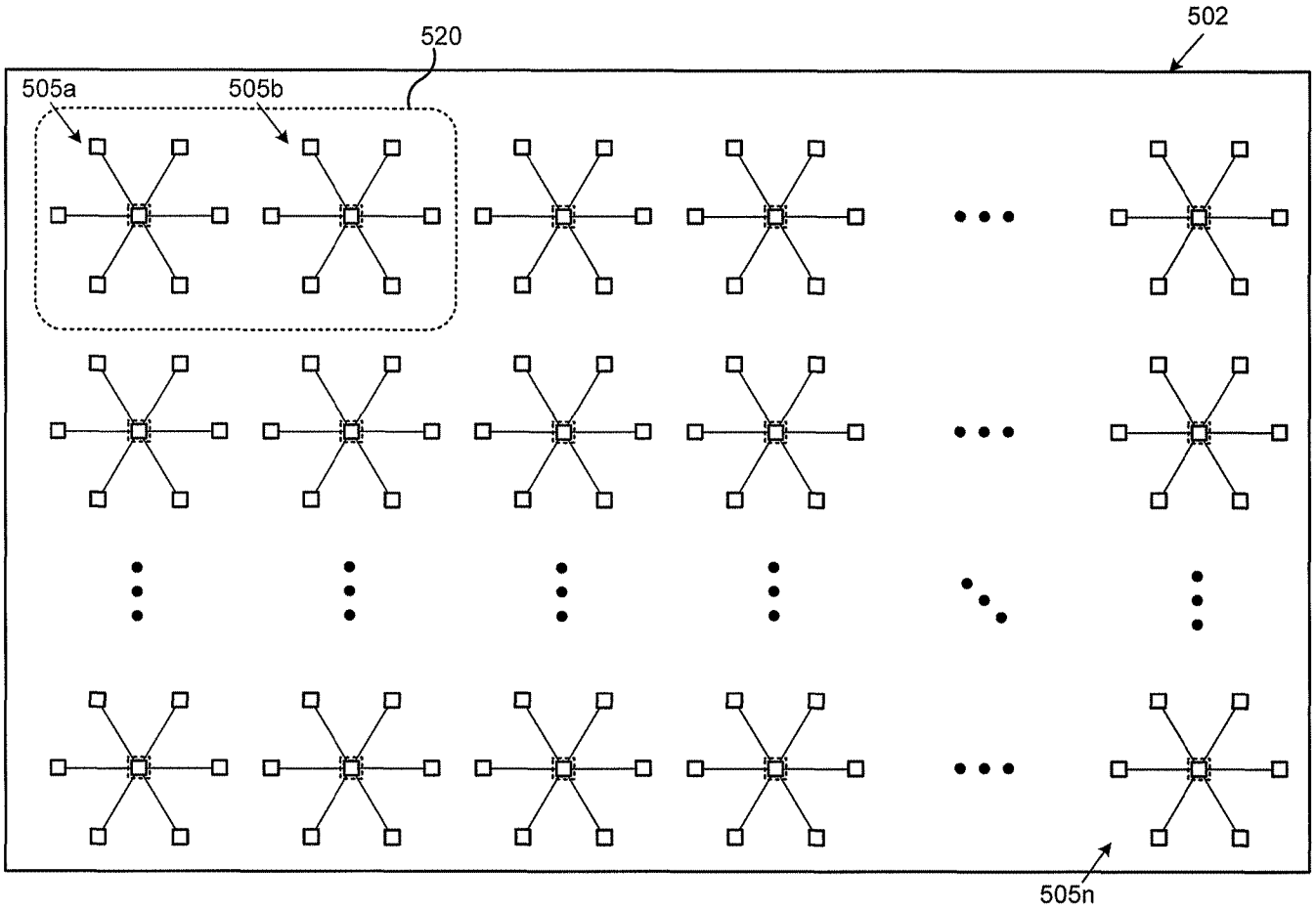
FIG. 5D illustrates a top plan view of a portion of an antenna panel of an exemplary wireless receiver according to one implementation of the present application.
Figure 5E:
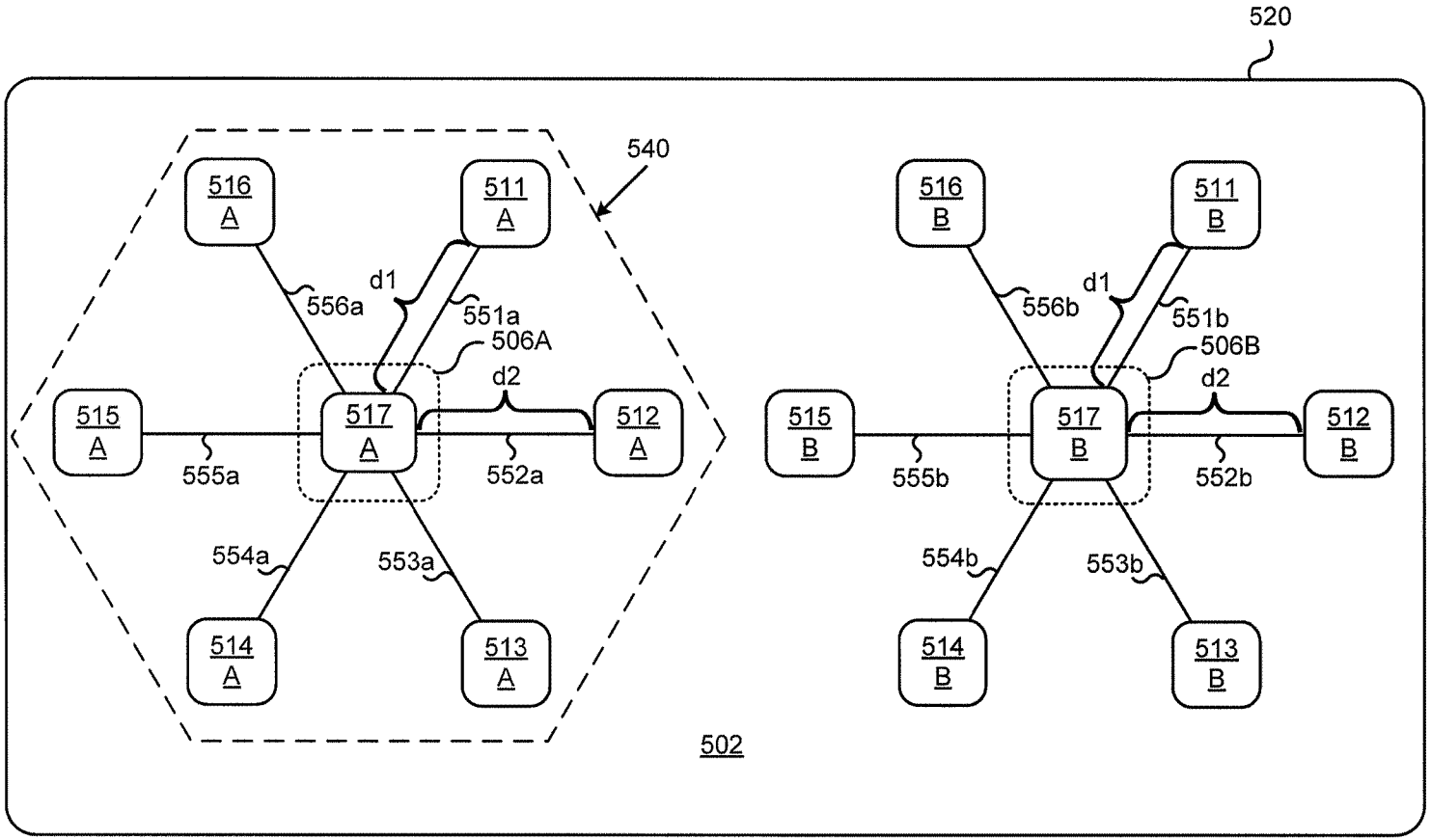
FIG. 5E illustrates a top plan view of a portion of an antenna panel of an exemplary wireless receiver according to one implementation of the present application.
Figure 5F:
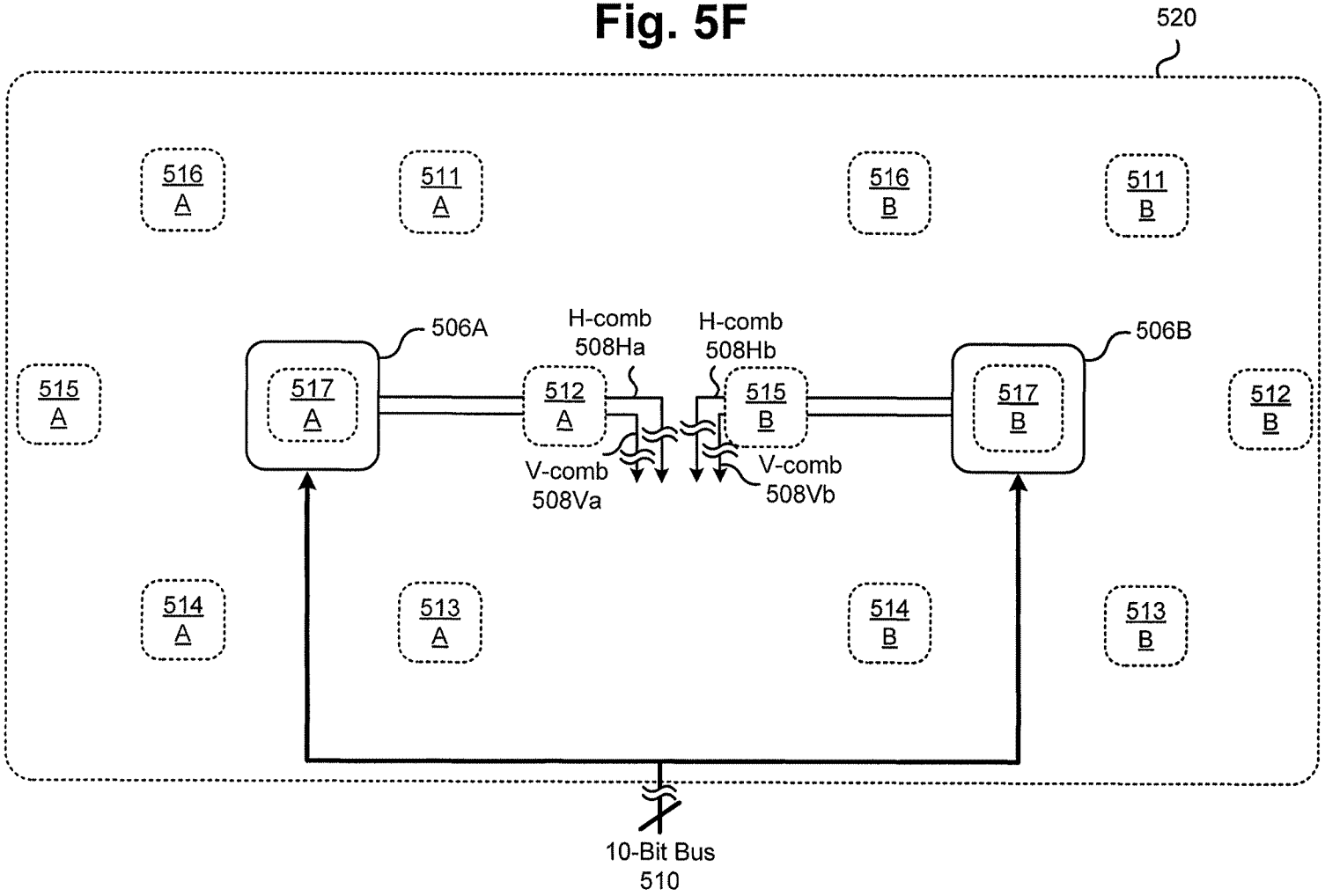
FIG. 5F illustrates a functional block diagram of a portion of an exemplary wireless receiver according to one implementation of the present application.

Referring to FIGS. 5D, 5E and 5F, with similar numerals representing similar features in FIGS. 5A, 5B and 5C, FIGS. 5D, 5E and 5F show an implementation, where each of RF front end units 505*a* through 505*n* includes an additional antenna in the center of the hexagonal-configuration. Thus, each of RF front end units 505*a* through 505*n* includes a group of seven antennas. It is noted that in the implementation shown in FIGS. 5D, 5E and 5F, the RF front end chips are each situated below the additional antenna in the center of the hexagonal-configuration. For example, antenna panel 502 may be a part of a multi-layer PCB having at least two layers, where antennas 511A, 512A, 513A, 514A, 515A, 516A, 517A, 511B, 512B, 513B, 514B, 515B, 516B and 517B are situated on antenna panel 502, as a top layer of the multi-layer PCB, while RF front end chips 506A and 506B are situated in another layer of the multi-layer PCB below the top layer. As shown in FIGS. 5D, 5E and 5F, RF front end chips 506A and 506B are situated directly below antennas 517A and 517B, respectively.

Figure 6A:
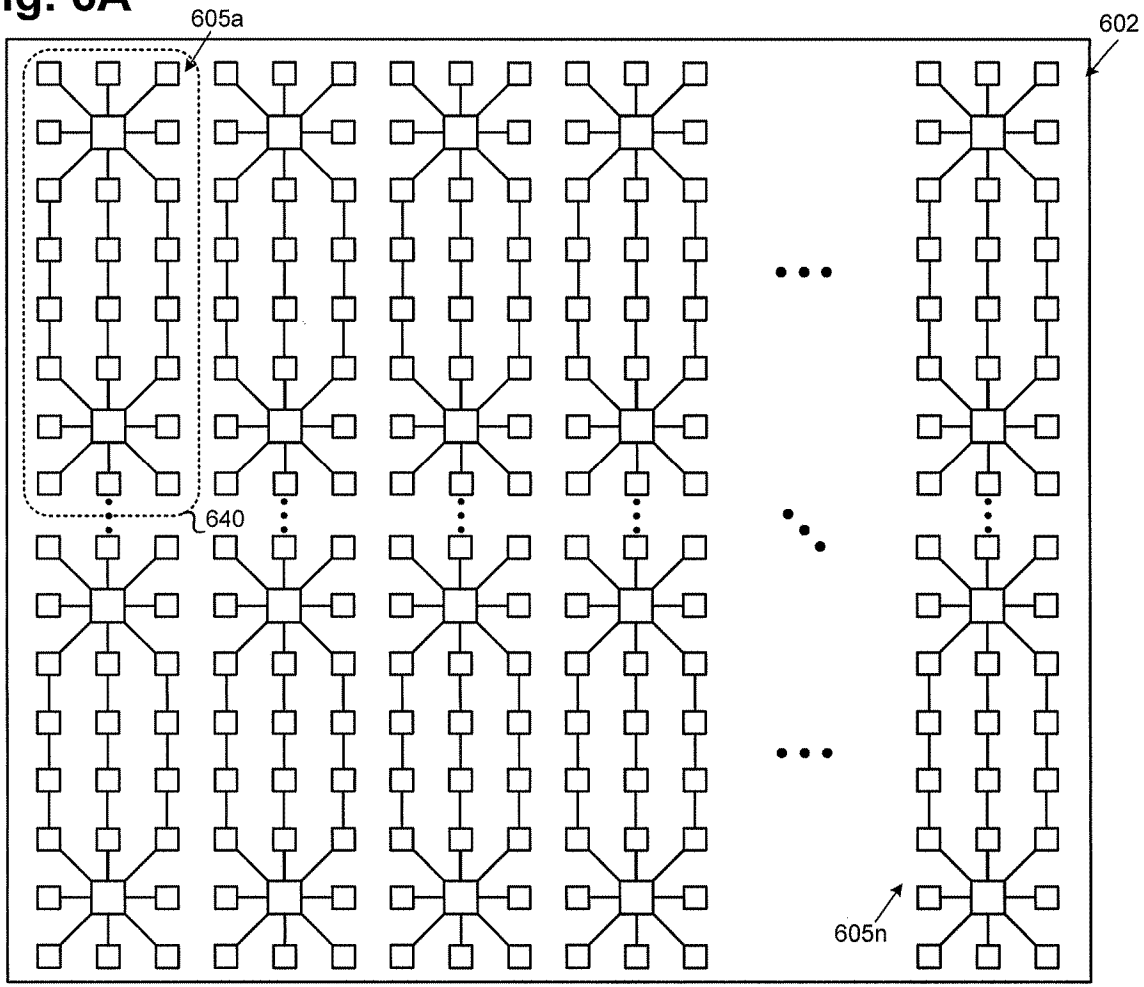
FIG. 6A illustrates a top plan view of a portion of an antenna panel of an exemplary wireless receiver according to one implementation of the present application.
Figure 6B:
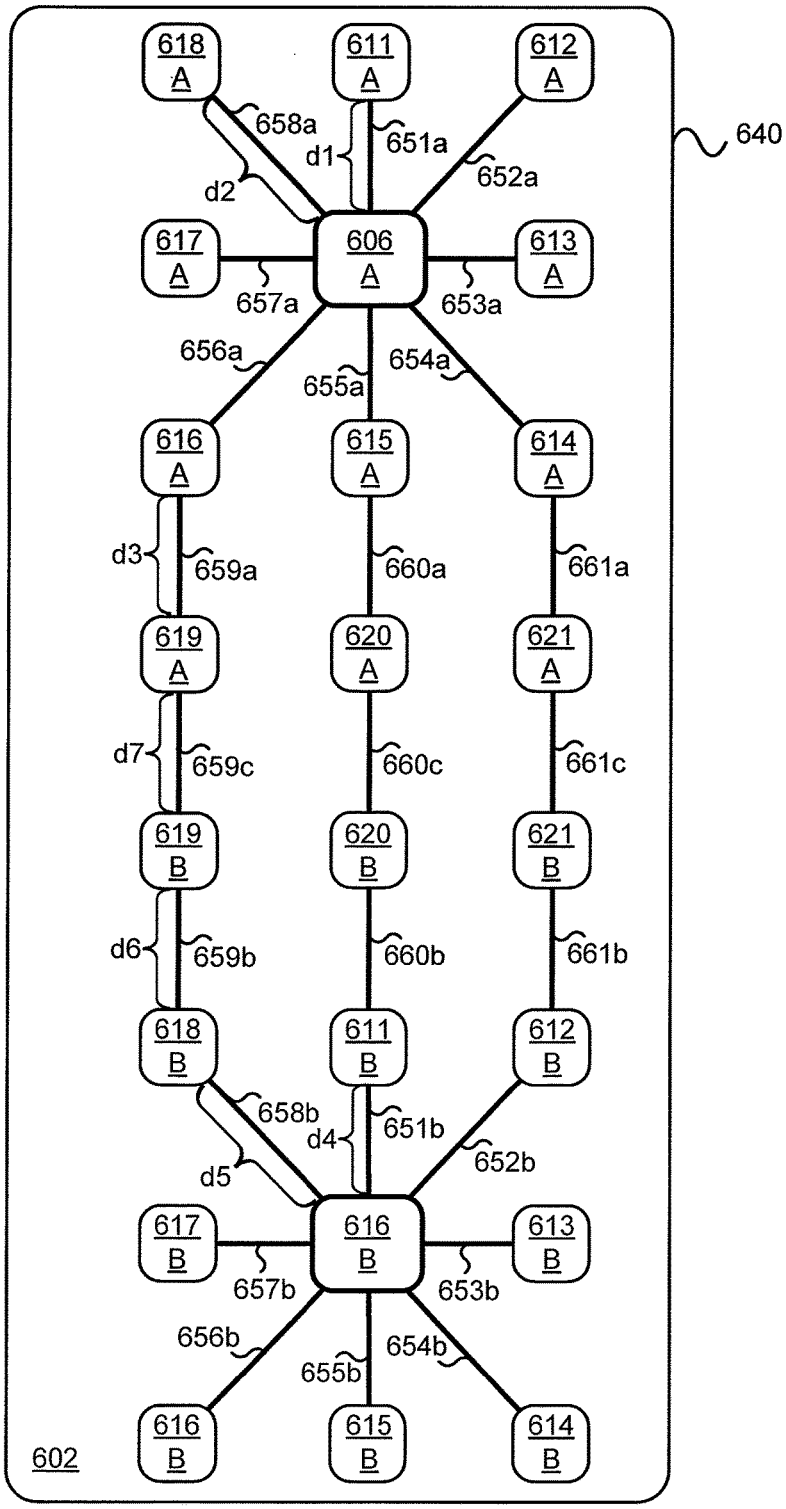
FIG. 6B illustrates a top plan view of a portion of an antenna panel of an exemplary wireless receiver according to one implementation of the present application.

Referring now to FIGS. 6A and 6B, FIG. 6A illustrates a top plan view of a portion of an antenna panel of an exemplary wireless receiver according to one implementation of the present application. FIG. 6B illustrates a section of the antenna panel in FIG. 6A. As illustrated in FIG. 6A, antenna panel 602 includes a plurality of RF front end units 605*a* through 605*n*. Each of RF front end units 605*a* through 605*n* includes a pair of RF front end chips surrounded by a group of antennas.

FIG. 6B shows an enlarged view of section 640 of antenna panel 602 in FIG. 6A. As illustrated in FIG. 6B, RF front end chip 606A is surrounded by a group of antennas, namely, antennas 611A, 612A, 613A, 614A, 615A, 616A, 617A, 618A, 619A, 620A and 621A. Antennas 611A, 612A, 613A, 614A, 615A, 616A, 617A and 618A are coupled to RF front end chip 606A through antenna feed lines 651*a*, 652*a*, 653*a*, 654*a*, 655*a*, 656*a*, 657*a* and 658*a*, respectively. In the present implementation, antenna feed lines 651*a*, 653*a*, 655*a* and 657*a* may each have length d1, while antenna feed lines 652*a*, 654*a*, 656*a* and 658*a* may each have length d2. In one implementation, d2=$\sqrt{2}$×d1, for example. In addition, antennas 619A, 620A and 621A are coupled to RF front end chip 606A through antennas 616A, 615A and 614A, respectively. As shown in FIG. 6B, antennas 619A, 620A and 621A are coupled to antennas 616A, 615A and 614A through antenna feed lines 659*a*, 660*a* and 661*a*, respectively. Antenna feed lines 659*a*, 660*a* and 661*a* may each have length d3. In one implementation, length d3 is equal to length d1.

Similarly, RF front end chip 606B is surrounded by a group of antennas, namely, antennas 611B, 612B, 613B, 614B, 615B, 616B, 617B, 618B, 619B, 620B and 621B. Antennas 611B, 612B, 613B, 614B, 615B, 616B, 617B and 618B are coupled to RF front end chip 606B through antenna feed lines 651*b*, 652*b*, 653*b*, 654*b*, 655*b*, 656*b*, 657*b* and 658*b*, respectively. In the present implementation, antenna feed lines 651*b*, 653*b*, 655*b* and 657*b* may each have length d4, while antenna feed lines 652*b*, 654*b*, 656*b* and 658*b* may each have length d5. In one implementation, d5=$\sqrt{2}$×d4, for example. In addition, antennas 619B, 620B and 621B are coupled to RF front end chip 606B through antennas 618B, 611B and 612B, respectively. As shown in FIG. 6B, antennas 619B, 620B and 621B are coupled to antennas 618B, 611B and 612B, through antenna feed lines 659*b*, 660*b* and 661*b*, respectively. Antenna feed lines 659*b*, 660*b* and 661*b* may each have length d6. In one implementation, length d6 is equal to length d1.

In one implementation, antennas 611A, 612A, 613A, 614A, 615A, 616A, 617A, 618A, 619A, 620A, 621A, 611B, 612B, 613B, 614B, 615B, 616B, 617B, 618B, 619B, 620B and 621B, and the other antennas on antenna panel 602 (collectively referred to as antennas 611 through 621) as shown in FIG. 6A, may be configured to receive signals from one or more wireless transmitters, such as commercial geostationary communication satellites or low earth orbit satellites having a very large bandwidth in the 10 GHz to 20 GHz frequency range and a very high data rate. In another implementation, antennas 611 through 621 on antenna panel 602 may be configured to receive signals in the 60 GHz frequency range, sometimes referred to as "60 GHz communications," which involve transmission and reception of millimeter wave signals. Among the applications for 60 GHz communications are wireless personal area networks, wireless high-definition television signal and Point-to-Point links.

In one implementation, for a wireless transmitter transmitting signals at 10 GHz (i.e., $\lambda$=30 mm), each of antenna in antenna panel 602 in a wireless receiver needs an area of at least a quarter wavelength (e.g., $\lambda/4$=7.5 mm) by a quarter wavelength (e.g., $\lambda/4$=7.5 mm) to receive the transmitted signals. As illustrated in FIGS. 6A and 6B, antennas 611 through 621 in antenna panel 602 may each have a substantially square shape having dimensions of 7.5 mm by 7.5 mm, for example. In one implementation, each adjacent pair of antennas may be separated by a distance of a multiple integer of the quarter wavelength (i.e., $n*\lambda/4$), such as 7.5 mm, 15 mm, 22.5 mm, and etc. In that implementation, each of antenna feed lines 651*a*, 653*a*, 655*a*, 657*a*, 659*a*, 660*a*, 661*a*, 651*b*, 653*b*, 655*b*, 657*b*, 659*b*, 660*b*, 661*b*, 659*c*, 660*c* and 661*c* may each have a length of a multiple integer of the half wavelength (i.e., $n*\lambda/2$), such as 15 mm, 30 mm, 45 mm, and etc.

In the present implementation, antenna panel 602 is a flat panel array, where antenna panel 602 is coupled to associated active circuits to form a beam for reception and/or transmission. In one implementation, the beam is formed fully electronically by means of phase and amplitude control circuits associated with antennas 611 through 621. Thus, antenna panel 602 can provide for beamforming without the use of any mechanical parts.

As shown in FIG. 6B, antennas 619A and 619B are connected by antenna feed line 659*c* resulting in antennas 616A, 619A, 619B and 618B being coupled in series with one-another. As such, antennas 616A, 619A, 619B and 618B are coupled between RF front end chips 606A and 606B, where RF front end chips 606A and 606B use differential signals to communicate with antennas 616A, 619A, 619B and 618B. Similarly, antennas 620A and 620B are connected by antenna feed line 660*c* resulting in antennas 615A, 620A, 620B and 611B being coupled in series with one-another. As such, antennas 615A, 620A, 620B and 611B are coupled between RF front end chips 606A and 606B, where RF front end chips 606A and 606B use differential signals to communicate with antennas 615A, 620A, 620B and 611B. As further shown in FIG. 6B, antennas 621A and 621B are connected by antenna feed line 661*c* resulting in antennas 614A, 621A, 621B and 611B being coupled in series with one-another. As such, antennas 614A, 621A, 621B and 612B are coupled between RF front end chips 606A and 606B, where RF front end chips 606A and 606B use differential signals to communicate with antennas 614A, 621A, 621B and 612B.

As can be seen in FIG. 6B, the present implementation uses a pair of RF front end chips (e.g., RF front end chips 606A and 606B) to communicate with a group of antennas in series connection (e.g., antennas 616A, 619A, 619B and 618B), which can reduce the number of RF front end chips required by the wireless receiver, thereby saving usable areas on the antenna panel. In addition, the antenna feed lines carry RF analog signals from the antennas to their corresponding RF front end chips. As can be seen in FIG. 6B, RF front end unit 605*a* also retains a symmetric configuration, which makes it easy for the wireless receiver to rout the signals in a symmetrical way, thereby reducing the overall length of the antenna feed lines and the cross-talk among them. In addition, RF front end unit 605*a* with symmetric routing can minimize transmission loss and path delays, and increase routing efficiency, especially for antenna panels with hundreds or thousands of antennas.

It is noted that in the present implementation, antennas 611 through 621, and RF front end chips 606A and 606B are formed on the same layer on antenna panel 602. In another implementation, antennas 611 through 621 of the wireless receiver may be formed on antenna panel 602, while RF front end chips 606A and 606B may be formed on another layer below antenna panel 602.

Figure 6C:
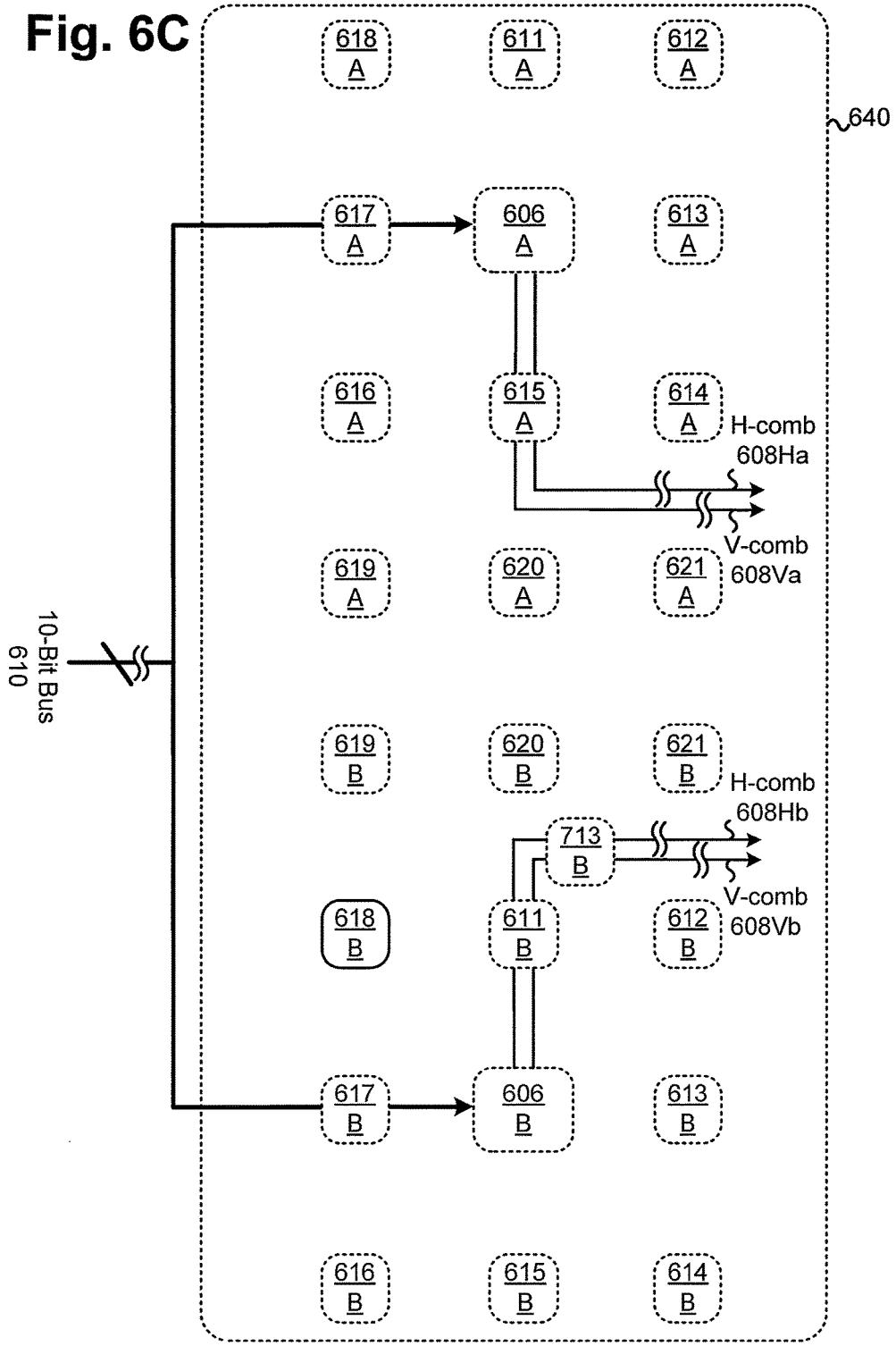
FIG. 6C illustrates a functional block diagram of a portion of an exemplary wireless receiver according to one implementation of the present application.

Referring now to FIG. 6C, FIG. 6C illustrates a functional block diagram of a portion of an exemplary wireless receiver according to one implementation of the present application. In the present implementation, section 640 in FIG. 6C may correspond to section 640 in FIGS. 6A and 6B. As shown in FIG. 6C, RF front end chip 606A provides H-combined output 608Ha and V-combined output 608Va to a master chip (not explicitly shown in FIG. 6C). RF front end chip 606B provides H-combined output 608Hb and V-combined output 608Vb to the master chip (not explicitly shown in FIG. 6C).

As illustrated in FIG. 6C, control bus 610 is provided, for example, from the master chip to RF front end chips 606A and 606B. In the present implementation, control bus 610 is a ten-bit control bus, for example. Control bus 610 may be configured to provide phase shift signals to one or more phase shifters (not explicitly shown in FIG. 6C) in RF front end chips 606A and 606B, where at least one of the phase shift signals is configured to cause a phase shift in at least one linearly polarized signal received from a corresponding antenna. In addition, control bus 610 may be configured to provide amplitude control signals to one or more amplifiers (not explicitly shown in FIG. 6C) in RF front end chips 606A and 606B, where at least one of the amplitude control signals is configured to cause a change in amplitude in at least one linearly polarized signal received from a corresponding antenna.

Although not explicitly shown in FIGS. 6A, 6B and 6C, in another implementation, each of RF front end units 605*a* through 605*n* may include two additional antennas situated directly over the corresponding RF front end chips in each of the RF front end units on antenna panel 602. For example, antenna panel 602 may be a part of a multi-layer PCB having at least two layers, where antennas 611 through 621, and the additional antennas are situated on antenna panel 602, as a top layer of the multi-layer PCB, while RF front end chips 606A and 606B are situated in another layer of the multi-layer PCB below the top layer.

Implementations of the present application use novel antenna arrangements and routing configurations for large scale integration of antennas with front end chips, which also make it easy for the wireless receiver to rout the signals in a symmetrical way, thereby reducing the overall length of the antenna feed lines and the cross-talk among them. In addition, these configurations with symmetric routing can minimize transmission loss and path delays, and increase routing efficiency, especially for antenna panels with hundreds or thousands of antennas, which can in turn increase signal strength and quality received by the RF front end chips and cause a reduction in bit error rate (BER) in the wireless receiver.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

The invention claimed is:

1. A wireless receiver comprising:

a plurality of RF front end chips receiving phase shift signals or amplitude control signals;

said plurality of RF front end chips outputting V-combined and H-combined signals;

a group of four antennas surrounding at least one of said plurality of RF front end chips.

2. The wireless receiver of claim 1 wherein said group of four antennas are in an H-configuration surrounding each of said plurality of RF front end chips.

3. The wireless receiver of claim 1 further comprising a fifth antenna situated over said at least one of said plurality of RF front end chips.

4. The wireless receiver of claim 1 wherein a respective group of four antennas surrounds each respective one of said plurality of RF front end chips.

5. The wireless receiver of claim 1 wherein said group of four antennas are coupled to said at least one of said plurality of RF front end chips through antenna feed lines having substantially equal lengths.

6. A wireless receiver comprising:

a plurality of RF front end chips receiving phase shift signals or amplitude control signals;

said plurality of RF front end chips outputting V-combined and H-combined signals;

a group of six antennas surrounding at least one of said plurality of RF front end chips.

7. The wireless receiver of claim 6 wherein said group of six antennas are in a hexagonal-configuration surrounding each of said plurality of RF front end chips.

8. The wireless receiver of claim 6 wherein said group of six antennas are in a rectangular-configuration surrounding each of said plurality of RF front end chips.

9. The wireless receiver of claim 6 further comprising a seventh antenna situated over said at least one of said plurality of RF front end chips.

10. The wireless receiver of claim 6 wherein a respective group of six antennas surrounds each respective one of said plurality of RF front end chips.

11. The wireless receiver of claim 6 wherein said group of six antennas are coupled to said at least one of said plurality of RF front end chips through antenna feed lines having substantially equal lengths.

12. A wireless receiver comprising:

a plurality of RF front end chips receiving phase shift signals or amplitude control signals;

said plurality of RF front end chips outputting V-combined and H-combined signals;

a group of eight antennas surrounding at least one of said plurality of RF front end chips.

13. The wireless receiver of claim 12 wherein said group of eight antennas are in an octagonal-configuration surrounding each of said plurality of RF front end chips.

14. The wireless receiver of claim 12 wherein said group of eight antennas are in a rectangular-configuration surrounding each of said plurality of RF front end chips.

15. The wireless receiver of claim 12 further comprising a ninth antenna situated over said at least one of said plurality of RF front end chips.

16. The wireless receiver of claim 12 wherein a respective group of eight antennas surrounds each respective one of said plurality of RF front end chips.

17. The wireless receiver of claim 12 wherein said group of eight antennas are coupled to said at least one of said plurality of RF front end chips through antenna feed lines having substantially equal lengths.

18. A wireless receiver comprising:

a plurality of RF front end chips receiving phase shift signals or amplitude control signals;

said plurality of RF front end chips outputting V-combined and H-combined signals;

a group of antennas surrounding a pair of RF front end chips of said plurality of RF front end chips;

wherein said pair of RF front end chips uses differential signals to communicate with at least two of said group of antennas.

19. The wireless receiver of claim 18 wherein said at least two of said group of antennas are connected in series between said pair of RF front end chips.

20. The wireless receiver of claim 18 wherein a respective group of antennas surrounds each respective pair of RF front end chips of said plurality of RF front end chips.

21. The wireless receiver of claim 18 wherein said pair of RF front end chips uses differential signals to communicate with at least four of said group of antennas.

* * * * *